US012545470B2

(12) United States Patent
Herrero Perez Rioja

(10) Patent No.: US 12,545,470 B2
(45) Date of Patent: Feb. 10, 2026

(54) CONTAINER WITH INDEPENDENT REINFORCEMENT FRAME

(71) Applicant: Juan Antonio Herrero Perez Rioja, Puebla (MX)

(72) Inventor: Juan Antonio Herrero Perez Rioja, Puebla (MX)

( * ) Notice: Subject to any disclaimer, the term of this patent is extended or adjusted under 35 U.S.C. 154(b) by 422 days.

(21) Appl. No.: 17/996,609

(22) PCT Filed: Jul. 20, 2022

(86) PCT No.: PCT/MX2022/050065
§ 371 (c)(1),
(2) Date: Oct. 19, 2022

(87) PCT Pub. No.: WO2024/019610
PCT Pub. Date: Jan. 25, 2024

(65) Prior Publication Data

US 2024/0217696 A1 Jul. 4, 2024

(51) Int. Cl.
*B65D 81/28* (2006.01)
*B65D 5/20* (2006.01)
(Continued)

(52) U.S. Cl.
CPC ..... *B65D 5/445* (2013.01); *B65D 5/2047* (2013.01); *B65D 5/28* (2013.01); *B65D 5/40* (2013.01);
(Continued)

(58) Field of Classification Search
CPC ..... B65D 5/246; B65D 5/443; B65D 5/6697; B65D 90/00; B65D 77/2024
(Continued)

(56) References Cited

U.S. PATENT DOCUMENTS 4,190,191 A 2/1980 Forbes
4,463,893 A * 8/1984 Brunone ..... B65D 5/66 229/125.36
(Continued)

FOREIGN PATENT DOCUMENTS

FR 2290358 6/1976
GB 2526560 12/2015
(Continued)

OTHER PUBLICATIONS

Bibliographic data: JP2006290368 (A), Paper Tray Having Sealability, Oct. 26, 2006, Machine Translation, 7 pages.*

*Primary Examiner* — Luan K Bui
(74) *Attorney, Agent, or Firm* — Defillo & Associates, Inc; Evelyn A. Defillo

(57) ABSTRACT

A container with an independent reinforcement frame, in particular to a container that has a detachable reinforcement section that adheres to the upper part of the container to increase its resistance during transport, storage and addition of goods inside the container and heat-sealable lids and more particularly, the container with an independent reinforcement frame is made up of a material made of cellulose where, derived from its configuration, advantages are obtained in terms of reducing the use of materials and increasing resistance where additionally, the container with an independent reinforcement frame can have a lid that comes off of the same material with which the independent reinforcement frame has been constructed.

34 Claims, 31 Drawing Sheets

(51) Int. Cl.

| | |
|---|---|
| ***B65D 5/28*** | (2006.01) |
| ***B65D 5/40*** | (2006.01) |
| ***B65D 5/44*** | (2006.01) |
| ***B65D 5/48*** | (2006.01) |
| ***B65D 5/56*** | (2006.01) |
| ***B65D 5/66*** | (2006.01) |
| ***B65D 81/20*** | (2006.01) |

(52) U.S. Cl.
CPC ..... *B65D 5/48016* (2013.01); *B65D 5/563* (2013.01); *B65D 5/6697* (2013.01); *B65D 81/2076* (2013.01)

(58) Field of Classification Search
USPC ..... 206/213.1, 557; 220/351, 359.1; 229/125.01, 125.11
See application file for complete search history.

(56) References Cited

U.S. PATENT DOCUMENTS

| | | | | |
|---|---|---|---|---|
| 5,839,574 | A * | 11/1998 | Lorence | B65D 77/0433 426/112 |
| 9,783,345 | B2 * | 10/2017 | Bentham | B65D 5/4266 |
| 2019/0023471 | A1 * | 1/2019 | Furuse | B65D 85/78 |
| 2022/0144490 | A1 * | 5/2022 | Brink | B65D 5/248 |
| 2024/0043163 | A1 * | 2/2024 | McLaughlin | B65D 5/20 |
| 2024/0400253 | A1 * | 12/2024 | Hoefte | B65D 5/563 |

FOREIGN PATENT DOCUMENTS

| | | |
|---|---|---|
| JP | 2001096644 | 4/2001 |
| JP | 2006290368 | 10/2006 |

* cited by examiner

CONTAINER WITH INDEPENDENT REINFORCEMENT FRAME

CROSS REFERENCE TO RELATED APPLICATION

This application is a national stage entry of PCT/MX2022/050065 filed Jul. 20, 2022, under the International Convention.

TECHNICAL FIELD

The present invention belongs to the technical field of packaging means; storage; handling of thin material containers for storage or transport of articles or materials, specifically to some type of rigid or semi-rigid containers of regular or irregular polygonal cross-section, e.g. example, trays, tray containers or containers, formed by folding or assembling one or more blanks of one of the components that they incorporate in their same structure, more specifically, the present invention refers to a tray, tray container or container that has some type of additional and independent structure aimed at increasing its resistance, stability and rigidity and even more specifically, the present invention refers to a container with an independent reinforcement frame.

BACKGROUND

In the state of the art, there is a series of elements that make up many types of known trays, tray containers or containers, which are used to contain goods for storage and transport, where these known structures are made of various materials, such as cardboard, paperboard, or different cellulose-based substrates and even wood, metal and plastic, however, all the known structures have, respectively, several disadvantages, such as fragility, little stability, limited capacity, easy incidence of humidity, high cost of production, use of excess material or in the case of trays, tray containers or containers that are not too fragile, they have the drawback that they can become too heavy. Particularly, none of the known trays, trays containers or containers that come to have some component in their structure that tends to be collapsible is suitable for all working conditions and the environment where they are usually established, such as, the stowage, the addition of load in series or load in production line, the incorporation of elements of different shapes and weight, the incorporation of organic load, the hot environment, conditions with some level of humidity, cold conditions. Therefore, there is a need or demand for a tray, tray container or container that is durable, can be used in any type of environment and at the same time said tray, tray container or container is cost effective or economical, in in terms of manufacturing and storage costs and ideally it should have elements that are foldable and adherable using conventional means of adhesion such as glue and should be easy to transport as a piece or flat pieces, reusable, light, with the possibility of being resistant to humidity and applicable to support a load for a relatively long period of time, in an additional plane it is known that ideally the tray or container should be recyclable.

Currently, no single tray or container can meet all of these requirements. most of these pieces are made of cardboard, waxed cardboard or thin plastic that allows to have some portion of its structure that can be folded to later adhere and maintain a union with other components of its structure (e.g., the thick plastic pieces cannot be easily folded). These containers usually use additional laminated layers, fillers, tongues, tabs, tabs reinforcements and means of adhesion to reinforce their walls or corners of the tray, tray container or container for better support, however the arrangements they have do not provide sufficient resistance or strong enough to resist loads using considerably less material during manufacture.

Currently in the field of trays, tray containers or commercial containers it is known that more ecological packaging solutions are sought in all senses, in the food area a proposal is the paper and cardboard trays that in addition to complying with the characteristics of being recyclable, biodegradable, among others, are very practical because they can be used as a support container or to transport products, and its manufacturing process, unlike products such as injected or thermoformed plastic containers, is that it allows changing shapes and sizes according to customer needs in a relatively easy way by making adjustments to cuts and folds or changing only small low-cost tools as opposed to, for example, having to replace a plastic injection mold, plus it can be printed, labeled, foliated or have some distinctive element on its surface, which allows, in addition, more than one very good image, being able to include all kinds of information in the same tray without the need for additional labelling.

The drawbacks found in the state of the art occur mainly when there is a problem with the paper or cardboard trays, tray containers or containers that currently exist on the market, since they make packaging, transport, and display difficult due to the following points:

1. In the absence of a perimeter frame, there are no functional solutions to put a sealed or pressure top cover where said cover is resistant.
2. The options that exist in the market with a perimeter frame are based on leaving a surplus of the material of the container walls that should normally be folded outward looking for them to be perpendicular to the upper perimeter of the tray, however, it has three problems:
3. The memory of the material with which they are made makes it normally return in different proportions, which hardly allows the frame to be perpendicular.
4. It is not strong enough to be supported only by the perimeter frame, which is necessary for many packaging processes, because the surface of the frame is formed by the independent sum of the sections of the frame that protrude from each of the walls. container and do not support each other.
5. Due to the low strength that these solutions present, the sealed lids on their surface cannot be kept tense enough, which in turn does not allow one tray with product and already covered to be stacked or placed on top of another without damaging or compressing it. bottom tray product, affecting costs and efficiencies in secondary packaging, freight, and display space.
6. In the case of the inventions that have reinforcements, this has a configuration that is too invasive, especially in the side walls, which achieves an increase in the resistance of the container at the expense of the excessive addition of material.
7. The reinforcing frame that is normally adhered does not comprise a continuous piece, that is, it is made up of a structure of several pieces that in turn represent several adhesions, increasing manufacturing times and, furthermore, said lack of continuity promotes complications during these subsequent sealing by containing discontinuous surfaces that complicate the implementation of a film or a cover.

8. In the case of the inventions that have reinforcements, this has a configuration that is formed together with the container body, which prevents varied materials from being used to form the container arrangement.
9. In the case of the inventions that have reinforcements, this has a configuration that has inefficient adhesion means that do not achieve a bond that supports the loads to which the container arrangement will be subjected.
10. The inventions of the state of the art that have a strong bonding means adding excess material to achieve said objective.
11. The inventions of the state of the art with reinforcement frames do not have a separable configuration that facilitates the manufacture and transport of the trays and frames separately.

BRIEF DESCRIPTION OF THE INVENTION

Notwithstanding the foregoing, there is also the problem that the trays or tray containers used conventionally or that are present in the state of the art, are generally arranged as a container that does not allow its content to be protected, additionally it is known that they have been developed trays that incorporate some type of external cover of some folding material that allows the tray to have some coverage. However, such lids are not suitable for contents where some level of assurance that the contents will not be tampered with is required. Therefore, it is preferred to use boxes whose bottom is made of cardboard and on which a transparent film or lid has been placed, arranged to observe its content in any case, in addition to obviously blocking access to the interior of the container by means of some element. mechanical that is complex to alter or that the intention to be altered is evident. In order to block the content, it is known that the lids of the state of the art may even comprise a portion of the lid in the upper part that, when closed, may even incorporate some blocking means such as a padlock or seal, however, in this last case, the realization of said covers and their placement are not easy and come to weaken the already fragile perimeter of the trays or containers of the state of the art. Furthermore, a locked closure of said lid is not always obtained.

The foregoing results in notorious disadvantages for the user since it prevents them from having these advantages and facilitating the use of these containers, reducing the applicability in the use of the trays, their reliability, and the integrity of the load they store. For these reasons, there is a need for a device that offers the possibility of solving the aforementioned problems.

This object is achieved by means of the device developed with the present invention and its preferred embodiments.

Therefore, it is an object of the present invention to provide a tray or container that has foldable elements to achieve its adhesion, where this assembly meets all the requirements established above.

It is another object of the present invention to provide a new blocking system for trays or containers that have folding means, which facilitates the quick assembly or disassembly of the tray or container, at the same time that it provides the tray or container with greater resistance and stability.

It is a further object of the present invention to provide a collapsible media tray or container which may have a number of partitions on its inside or at desired locations.

Another object of the invention consists of a container with an independent reinforcement frame with a much higher rigidity than the existing alternatives that allows greater support when sealing; keep the frame surfaces practically perpendicular to the upper contour of the container using a smaller amount of material and allowing it to have a wider variety of applications such as: selection of materials, stamping, sealing, transportation, coating treatments, among others.

It is a further object of the present invention to provide a tray or container that improves the strength of the support for stacking trays or tray containers and provides insulation and cushioning function to absorb impacts.

It is therefore a main object of protection, a container with an independent reinforcement frame characterized in that it integrates a portion of a tray or container and a reinforcement frame where the tray comprises a bottom wall that has a plurality of edges, depending on the number of sides conforming to said bottom wall wherein at least one side wall extends upwardly from each edge while a plurality of adjacent side walls are connected between the side walls and further wherein a closure flap is connected in an articulate way to the upper edge of each adjacent side wall and where said flaps can be folded towards the inside or outside of the tray or container to form a closing arrangement that could additionally incorporate protruding upper edges and where the reinforcing frame is made up of a single continuous piece where it comprises a central frame as a frame whose periphery Internal fair is coincident, although it may not be coincident with the upper part of the periphery of the receiving cavity that the tray or container has, so it comprises a regular or irregular polygonal shape, and where there is also a folding tab attached to said central frame by means of a folding section finding that said link is located on an outer side of said central frame, and where at each of its ends, the folding tab integrates a reinforcement tab which is it is arranged perpendicular to the folding section and to the side of the central frame that is coincident with said folding section and on the other hand, said reinforcing tab is also arranged linearly with respect to the side of the central frame that is perpendicular to the tab of lateral folding, and where when said folding tab is folded it adheres to the lower part of the upper edge of the tray or container that is arranged in a linear manner with said reinforcement tab, in the event that the tray or container has an excess frame on some side, the accommodation of the reinforcement tab is coincident with the lower surface of the central frame that is It is arranged linearly with said reinforcing tab.

In order to solve the problem of incorporating a lid or cover in trays or containers with an independent reinforcement frame, it is proposed that said independent reinforcement frame, for each of its embodiments, have a cover in the central cavity, where It has the advantage that its cover is obtained from the same material from which the independent reinforcing frame is obtained, so that with this incorporation it is possible to take advantage of the material that, if not used as a cover, would be discarded as manufacturing waste. To this end, the present invention also has as its object the incorporation of a cover that covers the hollow portion of the middle part of the independent reinforcement frame, where this cover comprises a body that, in most of its periphery, coincides with the internal periphery of the independent reinforcing frame, incorporating a plurality of joining means that protrude in the form of tabs or hinged fins on opposite edges of the lid, each one at least partially covering an upper surface of the independent reinforcing frame for adhesion partially or permanently, said tabs or flaps each further comprising at least one complementary locking means arranged on a side surface or with a complementary locking means carried by the other flap auxiliary tabs articulated on other edges of the lid or cover.

Thus, when placing the lid, a closure of the box is ensured by the joint action of the blocking means that the tabs carry with the complementary blocking means provided in this and/or in the other flaps of the tray or container to be covered.

Thus, according to a first embodiment, the lid comprises a projection turned towards the inside of the box when the lid is placed on the bottom and at least two opposite flaps, each provided with locking means that act together with locking means. Complementary lock provided on each lateral surface. from the base that the fins at least partially cover.

Preferably, the locking means are of the tongue/groove type, known per se, and, in the case of the modified embodiment, are provided respectively on the end tongues of the flaps of the lid.

BRIEF DESCRIPTION OF THE FIGURES

FIG. 23 shows a top view of a planar arrangement of one embodiment of the reinforcement frame (200).

FIG. 24 shows an isometric view of an embodiment of the reinforcement frame (200).

FIG. 29 shows an exploded isometric view of the container (100) with independent reinforcement frame (200).

FIG. 30 shows an isometric view of the container (100) with independent reinforcement frame (200).

FIG. 31 shows an exploded isometric view of the container (100) with independent reinforcement frame (200).

FIG. 32 shows an isometric view of the container (100) with independent reinforcement frame (200).

FIG. 39 shows an exploded isometric view of the container (100) with independent reinforcement frame (200).

FIG. 40 shows an isometric view of the container (100) with independent reinforcement frame (200).

FIG. 41 shows an exploded isometric view of the container (100) with independent reinforcement frame (200).

FIG. 42 shows an isometric view of the container (100) with independent reinforcement frame (200).

FIG. 55 shows an exploded isometric view of the container (100) with independent reinforcement frame (200).

FIG. 56 shows an isometric view of the container (100) with independent reinforcement frame (200).

FIG. 57 shows an exploded isometric view of the container (100) with independent reinforcement frame (200).

FIG. 58 shows an isometric view of the container (100) with independent reinforcement frame (200).

FIG. 59 shows a top view of a planar arrangement of one embodiment of the reinforcement frame (200).

FIG. 60 shows a top view of a planar arrangement of one embodiment of the reinforcement frame (200).

FIG. 61 shows a top view of a planar arrangement of one embodiment of the reinforcement frame (200).

FIG. 62 shows a top view of a planar arrangement of one embodiment of the reinforcement frame (200).

FIG. 63 shows an isometric view of an embodiment of the reinforcement frame (200).

FIG. 64 shows an exploded isometric view of the container (100) with independent reinforcement frame (200).

FIG. 65 shows an isometric view of the container (100) with independent reinforcement frame (200).

FIG. 66 shows an exploded isometric view of the container (100) with independent reinforcement frame (200).

FIG. 67 shows an isometric view of the container (100) with independent reinforcement frame (200).

FIG. 70 shows an exploded isometric view of the container (100) with independent reinforcement frame (200).

FIG. 71 shows an isometric view of the container (100) with independent reinforcement frame (200).

FIG. 72 shows an exploded isometric view of the container (100) with independent reinforcement frame (200).

FIG. 73 shows an isometric view of the container (100) with independent reinforcement frame (200).

FIG. 74 shows an exploded isometric view of the container (100) with independent reinforcement frame (200).

FIG. 75 shows an isometric view of the container (100) with independent reinforcement frame (200).

FIG. 120 shows an isometric view of the secondary reinforcement arrangement (300).

FIG. 121 shows a top view of the secondary reinforcement arrangement (300).

FIG. 122 shows an isometric view of the secondary reinforcement arrangement (300).

FIG. 123 shows an isometric view of the independent reinforcement frame (200).

FIG. 124 shows an isometric view of the independent reinforcement frame (200) placed in a container (100).

FIG. 125 shows a top view of a container (100) preform with lid (208).

FIG. 126 shows an isometric view of a container (100) with lid (208).

FIG. 127 shows a top view of a container (100) preform with lid (208).

FIG. 128 shows an isometric view of a container (100) with lid (208).

FIG. 129 shows a top view of the secondary reinforcement arrangement (300) incorporated in a container (100).

FIG. 130 shows an isometric view of the secondary reinforcement arrangement (300) incorporated in a container (100).

FIG. 131 shows a top view of the secondary reinforcement arrangement (300).

FIG. 132 shows a top view of the secondary reinforcement arrangement (300) incorporated in a container (100).

FIG. 133 shows an isometric view of the secondary reinforcement arrangement (300).

FIG. 134 shows an isometric view of the secondary reinforcement arrangement (300) incorporated in a container (100).

Figure 135:
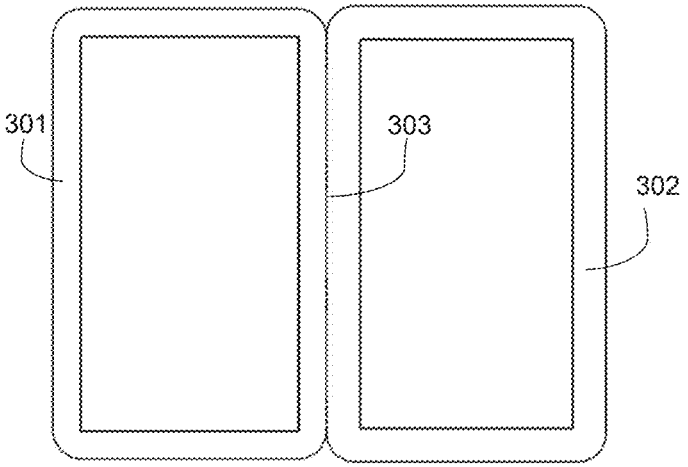

FIG. 135 shows a top view of the secondary reinforcement arrangement (300).

Figure 136:
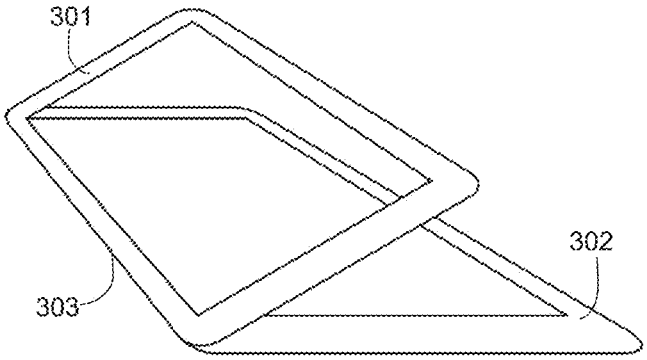

FIG. 136 shows an isometric view of the secondary reinforcement arrangement (300).

Figure 137:
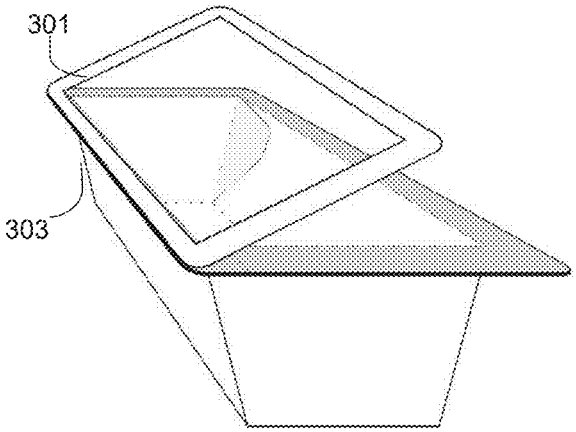

FIG. 137 shows an isometric view of the secondary reinforcement arrangement (300) incorporated in a container (100).

Figure 138:
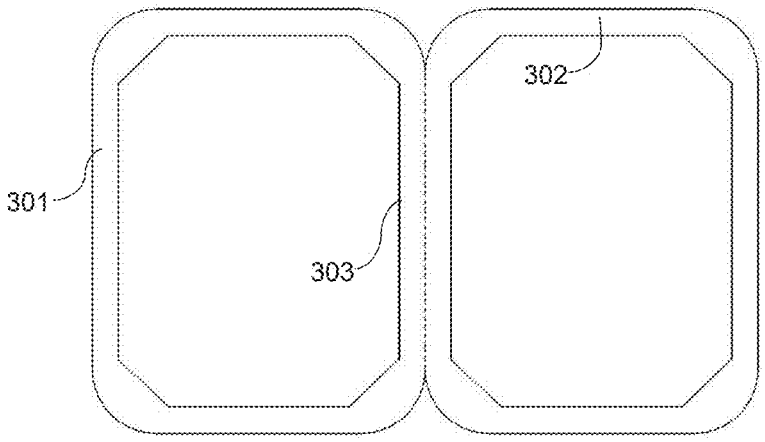

FIG. 138 shows a top view of the secondary reinforcement arrangement (300).

Figure 139:
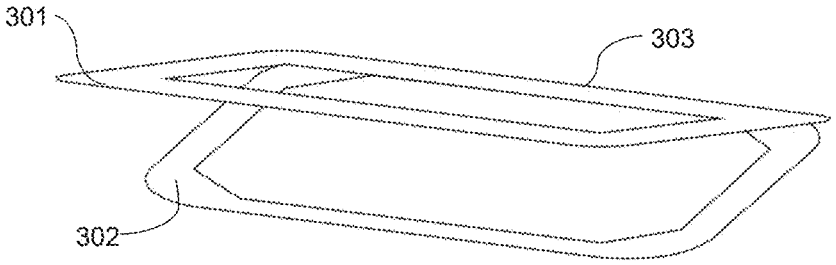

FIG. 139 shows an isometric view of the secondary reinforcement arrangement (300).

Figure 140:
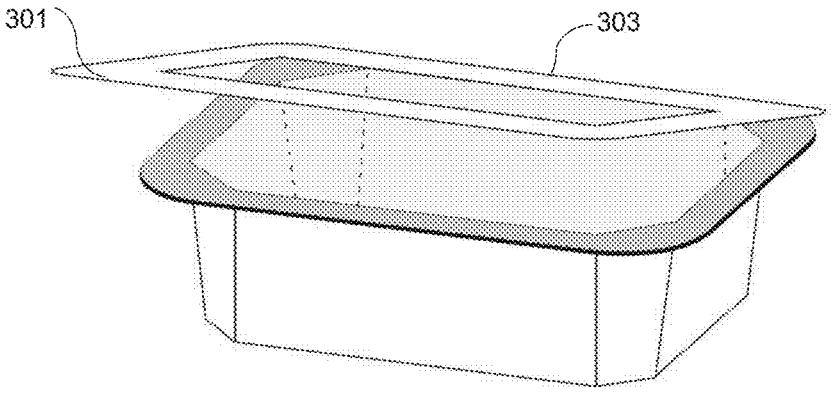

FIG. 140 shows an isometric view of the secondary reinforcement assembly (300) incorporated in a container (100).

Figure 141:
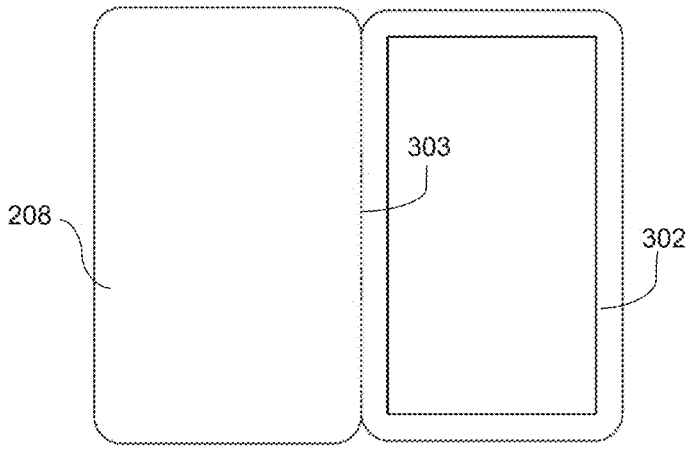

FIG. 141 shows a top view of the secondary reinforcement arrangement (300).

Figure 142:
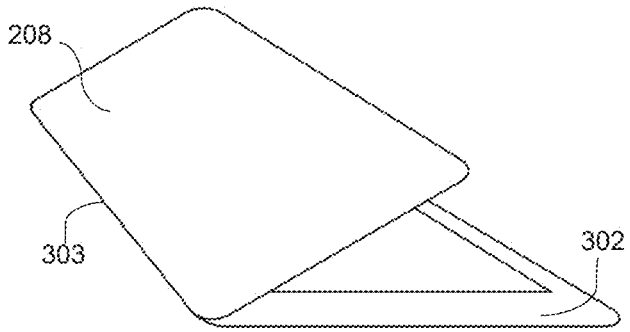

FIG. 142 shows an isometric view of the secondary reinforcement arrangement (300) incorporated in a container (100).

Figure 143:
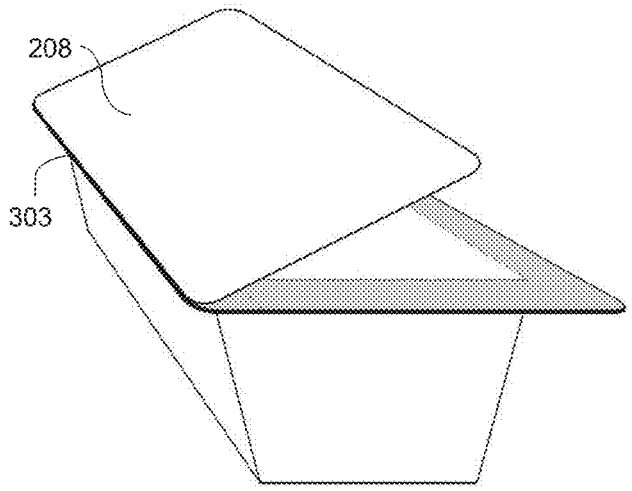

FIG. 143 shows an isometric view of the secondary reinforcement arrangement (300) incorporated in a container (100).

Figure 144:
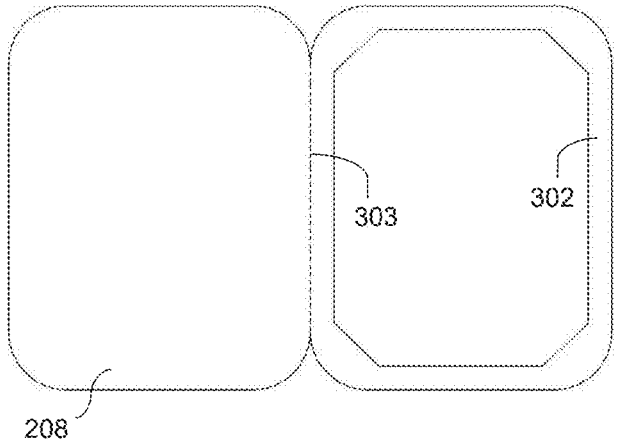

FIG. 144 shows a top view of the secondary reinforcement arrangement (300).

Figure 145:
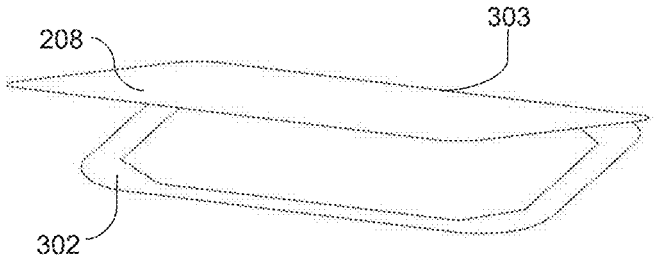

FIG. 145 shows an isometric view of the secondary reinforcement arrangement (300).

Figure 146:
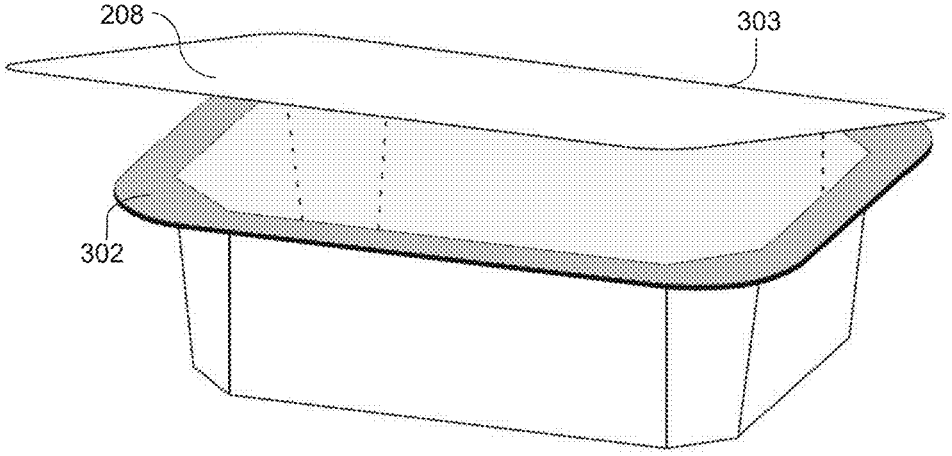

FIG. 146 shows an isometric view of the secondary reinforcement arrangement (300) incorporated in a container (100).

DESCRIPTION OF THE INVENTION

In accordance with the present invention, a container with an independent reinforcement frame is provided, where a container is formed from a preform that has folding elements and an independent reinforcement frame preform that also has folding and adhesive elements where both the container comprise die-cut or preformed cardboard in one piece, including said cardboard, in the case of the container preform, a bottom panel having a predetermined length and width defined by its side edges and end edges; a pair of side wall panels, each of which has a folding tab integrally connected to the side edge of the adjacent panels and folding along a first notched fold line to form the side wall of the container and wherein each of said side-wall panels optionally has a cover panel connected to its top edge opposite the folding edge and two end edges defining a width of the side wall panel that defines a height of the container; a pair of end wall panels, respectively, integrally connected to and extending from the end edges of the bottom panel, and folded along second fold lines marked thereon; and where the reinforcement frame contains a frame structure that has a polygonal, regular or irregular shape where a series of tabs can optionally be incorporated for its adhesion with the upper part of the container.

Alternatively, in addition to the first pair of connecting tabs, a second pair of connecting tabs is formed at predetermined locations on said wall panel.

In addition, a series of protruding tabs is formed along the top edges of the end wall panels, where said protruding tabs serve as connecting tabs located on the top edge of each container panel at predetermined positions. Therefore, the tabs of the container, on any of its walls, when adhering to one of the faces of the container, give it shape and rigidly hold it in position, that is, they restrict the movement of the container in all directions. Furthermore, there may be at least one groove in the bottom and in the walls of the container which, through a plurality of additional tabs, connects with an internal separating means in order to generate a multi-cavity arrangement inside the container.

Furthermore, a cover piece may be provided on top of the reinforcement frame, wherein said cover piece includes a panel that is integrally connected to the top surface of the reinforcement frame, and wherein said cover piece may comprise some cellulose-based substrate or a polymeric or metallic cover.

Another object of the invention is a container with a separate reinforcement frame, wherein the reinforcement frame includes a sealing surface that may extend inwardly and/or outwardly, parallel to the upper perimeter of the container.

Another object of the invention is a container with an independent reinforcement frame that allows one container to be stacked or placed on top of another without compressing the product in the lower container, either by resting on the lower lid or directly on the bottom of the container when it is empty.

Another object of the invention is a container with an independent reinforcement frame that allows one container to be stacked or placed on top of another with a more compact spacing, approximately equivalent to twice the thickness of the material from which the containers are made.

Another object of the invention is a container with an independent reinforcement frame whose essential characteristics allow the manufacture of different shapes in the internal and external profiles of the frame, since it constitutes an extension of the container walls or of the independent reinforcement frame itself.

Another object of the invention is a container with an independent reinforcement frame, whose essential characteristics allow the thickness of the container to be reduced without compromising its strength.

Another object of the invention is a container with an independent reinforcing frame that incorporate a metallic, polymeric, or micro ovenable film so, that the body of the container can contain liquids to avoid spills and even introduced into a microwave device without affecting its structure or structural composition.

Another object of the invention is a container with an independent reinforcement frame, in which the structure of the reinforcement frame and the container are elements that include characteristic and independent components with respect to each other.

Another object of the invention is a container with an independent reinforcement frame in which the structure of the reinforcement frame and the container are elements that can share or exchange structural elements for a different assembly, in all cases maintaining the result of adhesion and conformation of a resistance or reinforcement frame composed of one or more pieces.

The objectives of the present invention, including those previously stated and others not expressly mentioned, will become apparent from the following description and the accompanying figures, which are provided for illustrative and non-limiting purposes.

In accordance with the embodiments of the present description, any suitable type of paper may be used to manufacture a container with an independent reinforcement frame. For example, manila paper, cardboard, Kraft cardboard, caple cardboard, SBS cardboard, multilayer cardboard, among others may be used. In addition, paper or other cellulose-base substrates of any thickness may be used to produce the container in accordance with the embodiments of the present disclosure. The paper or manufacturing material (e.g., thin plastic) is preferably, but not necessarily of porous construction as this facilitates more effective bonding.

Furthermore, the embodiments of the present disclosure do not necessarily require paper taken from paper rolls. In particular, sheets of pre-cut paper can be used to form each container with an independent reinforcement frame, both for the container and for the reinforcement frame itself, in any of the embodiments of the present invention, as will be evident from the following descriptions and the accompanying figures. Another aspect of the present invention is that the cardboard, paper or other base material used for the construction of the container and the reinforcement frame may be cut to size. A person skilled in the art will appreciate the various methods by which the paper or other base material may be cut, including, for example, a blade, press, knife, guillotine, punch, reciprocating blade, die, or laser.

According to other embodiments of the present description, the paper may be laminated to a film including, for example, PE, PET, PVC, PEEK, or other polymer-based films and even some metallic material.

Likewise, when a non-fibrous or non-paper substrate is used, various chemical means may be employed to join the different pliable elements that form part of the container structure, such as sides, flaps, or connecting portions. In addition, techniques such as heat sealing processes may also be used to bond these elements together.

According to the embodiments of the present description, the sides of the container may include graphics, labels, among other elements printed, silk-screened, or batched onto a continuous sheet of material (e.g., paper, cardboard, etc.) either before or after the material is cut, creased, folded, or otherwise processed by the various steps of a manufacturing machine. The material with the added graphic may then be indexed prior to subsequent processing. A person skilled in the art will appreciate that some graphics application medium may be inserted at various stages of the manufacturing process, or may be integrated with another component, such as a drying promoter. Additionally, the fact that the present disclosure allows the use of a thin substrate enables greater flexibility in the placement of a graphics application medium in a linear production process, whether using single-pass or multi-pass systems, single or multicolor steps, and may also include devices that apply engraving, carving, marking, stamping, embossing, or watermark printing.

The present disclosure is directed to a container with an independent reinforcement frame, which is essentially composed of two main parts in its primary embodiment: a container (100) and a reinforcement frame (200), both of which may include variants that will be described in this specification.

It is important to mention that the fact that the container (100) and the reinforcement frame (200) are configured as independent elements provides a number of advantages over other containers known in the prior art, for example:

There is greater resistance inherent to the frame's own structure, since it has independent means in its structural composition that allow it to promote greater adhesion and contact force with the body of the tray or container, which does not prevent said adhesion from being achieved. in automatic filling processes and both high-speed industrial and manual sealing processes.

It is possible to incorporate materials of different gauges for the tray and reinforcement frame assemblies, which in turn gives the user the freedom to make a wider selection of materials in terms of color, finish and/or gauge/material thickness, emphasizing that, for example, allowing smaller gauge materials to be used translates into lower costs and that smaller gauge materials are more readily available in the applicant's experience.

An additional advantage is that different treatments may be applied to the container bodies and reinforcement frame, since being independent elements, it is possible, for example, to apply stamping or image additions to the container preform without damaging the frame, or vice versa. This means that the visual areas of the entire set can be utilized more efficiently.

In this arrangement, the container (100) together with the independent reinforcement frame (200), by being assembled as separate bodies, exhibit a perpendicular orientation between their respective fibers which provides greater rigidity compared to a continuous configuration.

With this construction, the container with independent reinforcement frame of the present invention has several advantages:

In the first place, the parts that make up the container or the reinforcement frame can be obtained using relatively simple equipment and can be easily adapted to switch from one model to another.

In addition, the individual pieces are relatively lightweight and not very bulky, which makes them easy to handle, store, and transport.

For example, once produced, the pieces can be printed, dried, and stored individually, resulting in significant savings in space and time, and they can be assembled by folding or gluing processes using machinery configured for such purposes.

Due to their ease of transport and storage, the parts can be manufactured separately in one or multiple locations and then shipped together or separately to another location for assembly, even in another region or country.

Another important advantage is that all the configurations, cuts, tabs, and component delimitations necessary for anchoring, positioning, and centering the container, the reinforcement frame, and of the other associated components are incorporated directly into the container elements and can be obtained in a single cutting operation, optionally controlled by a computer, which provides great ease, reliability, and precision in the setup of the cutting means to be used.

Likewise, the construction type of the structure of the present invention allows for the easy implementation of a modular design for the bases and fastening means associated with different cutting systems, using, for example, some common pieces and others simply scaled in one or more of their dimensions.

Likewise, the type of construction of the structure of the present invention allows to easy implementation of different types or gauges of materials for the container and reinforcement frame portions.

Additionally, separating means may be incorporated into the containers to promote internal sectioning during use for containment purposes.

In addition, the container and the reinforcement frame according to the present invention exhibit a remarkably high rigidity and strength due to a fiber mesh configuration in which the cardboard fibers are arranged perpendicularly. This configuration allows the incorporation of a combination of flat areas, possibly with folds and grooves, which provides the containment element with great lightness, a high moment of inertia, and great resistance.

The joints by the selected adhesive medium are simple, strong, and resistant to loosening caused by external factors, such as vibrations.

The support structure according to the present invention can be applied to the containment of solids, liquids or combinations thereof.

The design of the reinforcement frame and container elements includes all two-dimensional shapes that can be obtained during an initial cutting stage, (such as contours, windows, notches, and holes) as well as three-dimensional shapes that result from subsequent folding stage, such as fins, folds, and grooves. The cutting may be performed, for example, by punching, laser cutting or by any other cutting device capable of being computer-controlled. Folding may be carried out by means of a container former. In addition, the use of high-cost molds or dies, specific for each model, is avoided.

In one embodiment, each of the portions that make up the invention may be stored in a collapsible arrangement, in which the portions are folded in a complementary manner. Next, the portions of the container and reinforcement frame are joined and glued on their respective sides. The overlapping side parts of the container are completely covered with an adhesive medium when assembled, creating a strong composite structure.

Likewise, the container and reinforcement frame assembly can be received in a die-cutting module. Here the paper is cut into the desired shape and optionally scored and/or folded. The die cutting module can cut portions of the paper tape that will form the tabs and sides of the container.

In yet another embodiment, a linear print promoter can receive the container to print directly onto its surface at any point in the process.

The container (100) on which the reinforcement frame (200) rests is contemplated within the assumptions indicated above while the reinforcement frame (200) is also obtained by the same technique, that is, from folding and adhesive support elements formed by cutting and folding, assembled and bonded together preferably by means of adhesives or adhesion promoters such as, for example, wet glues, contact glues, reactive glues, one-component reactive glues, two-component reactive glues or more components, hot melt glues, self-adhesive, among others.

Next, each of the embodiments of the present invention will be described, for the container (100) may be configured according the following preferred embodiments:

Container without Excess Frame (110)

In this embodiment of the container, its body is generally of conventional construction, comprising a bottom wall (101) having a regular or irregular polygonal shape which includes a plurality of edges (102), corresponding to the number of sides defining said bottom wall. Preferably at least one sidewall (103) extends upwardly from each edge (102), while a plurality of adjacent sidewalls (104) is connected between the sidewalls (103). Additionally, a closure flap (106) is articulately connected to the upper edge of each adjacent sidewall (104). The closure flaps (106) can be folded inwardly or outwardly relative to the container to form a closure arrangement.

Container with Excess Frame on Two Sides (120)

Optionally, the container (100) is provided, which is generally of conventional construction, comprising a bottom wall (101) of regular or irregular polygonal shape that has a plurality of edges (102), from each of which a sidewall (103) extends upwardly. A plurality of adjacent sidewalls (104) are connected between the sidewalls (103). Additionally, each sidewall (103) has a top edge (105), which is foldable and adopts a horizontal configuration when the container (100) is assembled. A closure flap (106) is articulately connected to the upper edge of each sidewall (103), wherein the closure flaps (106) can be folded inwardly or outwardly relative to the container to form a locking arrangement.

Container with Excess Frame on all Sides (130)

Optionally, the container (100) is provided, which is generally of conventional construction, comprising a bottom wall (101) of regular or irregular polygonal shape that has a plurality of edges (102), from each of which a sidewall (103) extends upwardly. A plurality of adjacent sidewalls (104) are connected between the sidewalls (103). Additionally, each sidewall (103) has a top edge (105) which is foldable and adopts a horizontal configuration when the container (100) is assembled. A closure flap (106) is articulately connected to the upper edge of each adjacent sidewall (104), wherein the closure flaps (106) can be folded inwardly or outwardly relative to the container to form a closure arrangement. Moreover, each adjacent sidewall (104) has a secondary upper edge (107) which is likewise foldable to be fixed by means of an adhesive medium that joins it with the top edge (105). Therefore, said secondary upper edge (107) also adopts a horizontal configuration once the container is assembled.

Tray with Anti-Spill Arrangement (140)

Optionally, the container body (100) is provided which generally of conventional construction, comprising a bottom wall (101) of regular or irregular polygonal shape that has a plurality of edges (102) from each of which a side wall (103) extends upwardly. A plurality of adjacent sidewalls (104) are connected between the sidewalls (103). Additionally, each sidewall (103) has a top edge (105) which is foldable and has a horizontal configuration when the container is assembled. A closure flap (108) is articulately connected to the upper edge of each adjacent side wall (104), wherein the closure flaps (108) can be folded inwardly or outwardly relative to the container to form a closure arrangement. Moreover, each of the adjacent side walls (104) has a secondary upper edge (107) which is likewise foldable to achieve fixing through an adhesive medium that joins it with the top edge (105). Therefore, said secondary upper edge (107) also has a horizontal configuration once the container (100) is assembled.

In the same way, an anti-spill arrangement is provided where an intermediate tab (108*a*) is arranged between the sidewalls (103) and adjacent sidewalls (104) of the container (100) adhering to each of the walls and promoting a containment barrier to prevent the eventual spillage of any substance when draining a liquid. The intermediate tab (108*a*) has a configuration with folds on each of its sides, which facilitate its bending to allow for easier adhesion during the assembly process.

Container with Separator (150)

Optionally, the container (100) is provided, which is generally of conventional construction, comprising a bottom wall (101) of regular or irregular polygonal shape, having a plurality of edges (102) where its vertices have a beveled termination and wherein a sidewall (103) extends towards each of the sides of each edge (102). A plurality of adjacent sidewalls (104) are connected between the sidewalls (103). Additionally, each sidewall (103) has a top edge (105), which is foldable and has a horizontal configuration when the container (100) is assembled The top edge (105) extends to the top of some closure flaps (106) which are articulately connected to the upper edge of each sidewall (103), and similarly incorporated into the upper part of each of the adjacent sidewalls (104). These adjacent sidewalls (104) integrate a secondary upper edge (107) where the closure flaps (106) can be folded inwardly or outwardly relative to the container to form a closure arrangement. Additionally, a portion of the bottom wall (101) consists of a groove (111), which optionally extends to an area close to the middle part of each of the sidewalls (103) and which consists of spacer tabs (112) arranged on each side of the groove. These spacer tabs (112) are arranged to fold inwardly or outwardly relative to the container. The spacer tabs (112) are joined with a separating means (113) which consists of a dividing body incorporating a plurality of separating walls (114). Each separating walls (114) has a bottom tab (115) that connects with the bottom wall (101) of the container (100), as well as an upper profile (116) referring to the highest portion of the separating medium The spacer tabs (112) join with the separating means (113) to achieve the arrangement of cavities inside the container (100).

The previous description of the separators is only examples, since within the scope of the present invention the separators may have different shapes and structures. The container (100) may have one or more separators and therefore the container (100) may have more than two compartments to store various products. such as food, personal items, liquid or pasty solutions, among others. The separators, when the container (100) has a separator are in the middle part of the container (100), but they may also be in positions that are not the middle part of the container (100) which means that the volume of packaging and transport of the various products mainly, in each compartment is not the same. When there is more than one separator in the container (100), the separators are in equidistant positions, but they may also be positioned in the container (100) in ways that are not equidistant, thus changing the volume of packaging and transport of various products, articles or utensils in each compartment. The separators may have different heights, depending on the needs of the application to which they are intended. The separator and the container (100) are designed in such a way that they can be stacked one on top of the other for a more efficient way of transport. Additionally, an opening at the bottom of the separator is left, and a cut is made in the walls of the separator, the width of which is the same as the separator and the height may be equal to or less than that of the separator.

The aforementioned preferred embodiments promote the formation of a container comprising a plurality of sides defined by the sidewalls (103) and the adjacent sidewalls (104) where the number of sides may be three, four, five, six, seven, eight, nine, ten, eleven, twelve or more sides In the aforementioned case(s) reference is made to the images contained in FIGS. 1-10 for a four-sided container, however the same description applies to, for example, the containers illustrated in FIGS. 12-16, where they have eight sides and where there is:

Container without Excess Frame (110) where the Container has More than Four Sides In this embodiment of the container, its body is generally of conventional construction, comprising a bottom wall (101) of regular or irregular polygonal shape that has a plurality of edges (102) where its vertices have of a beveled finish and wherein a sidewall (103) extends outwardly from each of the sides of each edge (102) A plurality of adjacent sidewalls (104) are connected between the sidewalls (103). Furthermore, a closure flap (106) is articulately connected to the upper and lower edges of each sidewall (103) and each adjacent sidewall (104). The closure flaps (106) can be folded towards the inside or outside of the container to form a closing arrangement where they meet to form an additional wall when adhered according to a container arrangement. For the case of FIGS. 12-16 comprises eight sides.

Container with Excess Frame on More than Two Sides (120) in a Container with More than Four Sides Optionally, the container (100) is provided, which is generally conventional construction, comprising a bottom wall (101) with a polygonal, regular or irregular shape that has a plurality of edges (102). Its vertices have a beveled finish and wherein a sidewall (103) extends towards each of the sides of each edge (102) A plurality of adjacent sidewalls (104) are connected between the side walls (103). Additionally, each sidewall (103) has a top edge (105), which is foldable and has a horizontal configuration when the container is assembled. Said top edge (105) extends to the top of closure flaps (106) which are articulately connected to the upper edge of each sidewall (103) and similarly incorporated into the upper part of each of the adjacent sidewalls (104). The closure flaps (106) can be folded inwardly or outwardly relative to the container to form a closing arrangement.

Container with Excess Frame on all Sides (130) in a Container with More than Four Sides.

Optionally, the container (100) is provided, which is generally of conventional construction, comprising a bottom wall (101) of regular or irregular polygonal shape that has a plurality of edges (102) where its vertices have a beveled termination and wherein a sidewall (103) extends towards each of the sides of each edge (102). A plurality of adjacent sidewalls (104) are connected between the sidewalls (103). Additionally, each sidewall (103) has a top edge (105), which is foldable and adopts a horizontal configuration when the container (100) is assembled. Said top edge (105) extends to the top of some closure flaps (106) that are connected in an articulated way to the upper edge of each sidewall (103), and similarly incorporated into the upper part of each of the adjacent sidewalls (104), where said side walls integrate a secondary upper edge (107). The closure flaps (106) can be folded inwardly or outwardly relative to the container to form a closing arrangement.

Container with Reinforcement Tabs Included in its Upper Part (160).

Optionally, there is a container arrangement with an independent reinforcement frame, where the container (100) incorporates an excess arrangement with the addition of reinforcement tabs (204). In this embodiment of the invention, the container (100) is generally of conventional construction, comprising a bottom wall (101) of regular or irregular polygonal shape that has a plurality of edges (102), from each of which a sidewall (103) extends upwardly. A plurality of adjacent sidewalls (104) are connected between the sidewalls (103). Additionally, each sidewall (103) has a top edge (105), which is foldable and adopts a horizontal configuration when the container (100) is assembled. A closure flap (106) is articulately connected to the upper edge of each sidewall (103), wherein the closure flaps (106) can be folded inwardly or outwardly relative to the container to form a closing arrangement. Moreover, in a preferred embodiment of this container, each of the adjacent sidewalls (104) integrates a secondary upper edge (107) which is likewise foldable in the same manner to achieve fixation through an adhesive medium that joins it with the top edge (105). Consequently, the secondary upper edge (107) also adopts a horizontal configuration once the container (100) is assembled. Furthermore, a folding tab (202) is positioned adjacent to each top edge (105), wherein said union is promoted by a folding section (203) that is located on the outer side of said top edge (105). At each of its ends, the folding tab (202) incorporates a reinforcement tab (204), which is arranged perpendicularly to the folding section (203) and to the side of the top edge (105) that coincides with said folding section (203). Additionally, the reinforcement tab (204) is arranged linearly with respect to the side of the top edge (105) that is perpendicular to the lateral folding tab (202). When the folding tab (202) is folded, it adheres to the lower part of the reinforcement frame (200) that is free of adhesion tabs and that is placed on top of the container (100).

The combination of the components of the previously described containers (100), is also considered.

The container (100) with an independent reinforcement frame (200) is made, although not limited to these materials, with cardboard, or any cellulose-based material where the use or application of a multilayer is contemplated, preferably utilizing a cardboard that maintains at least two layers.

Additionally, any of the previous embodiments of the container (100) can integrate a coating with a polymeric material film.

Additionally, any of the previous embodiments of the container (100) can integrate a coating with a polymeric material film that is removable from the body of the container enabling its classification in a recycling stage (cellulose portion/polymer portion).

Additionally, any of the previous embodiments of the container (100) can integrate a coating or lamination with an additional layer of materials such as aluminum and/or a thin metal sheet that does not prevent its bending and that, when folded, maintains the folding characteristics. and components of the aforementioned container (100) in addition to improving its temperature transmission properties.

In accordance with the foregoing, the container (100) can alternatively incorporate a polymeric thermoformed film (109), which is placed on the upper part of the container and thermoformed inside, sealing the walls of the container and maintaining the shape of the interior, thus ensuring complete isolation on the sides of the container where adhesion tabs are incorporated.

In an alternative embodiment of the invention, a thermoformed film (109) is also provided on the preform of the container, where this container is formed with the adhered film.

As for the independent reinforcement frame (200), it has a series of preferred embodiments in which six main variants are incorporated.

I. Independent reinforcement frame (200) free of reinforcement tabs.

II. Independent reinforcement frame (200) with external reinforcement tabs (205).

III. Independent reinforcement frame (200) with internal reinforcement tabs (206).

IV. Independent reinforcement frame (200) with both external (205) and internal reinforcement tabs (206).

V. Independent reinforcement frame free of folding tabs (202).

VI. Independent reinforcement frame (200) free of tabs.

I. Independent Reinforcement Frame (200) Free of Reinforcement Tabs.

According to an example of embodiment, the reinforcement frame (200) is ideally made up of a single continuous piece, comprising a central frame (201) that serves as the main frame, which integrally and directly supports the other components of the reinforcement frame (200). The configuration of its internal periphery (201*a*) is ideally coincident with, although it may not coincide with, the upper part of the periphery of the receiving cavity in the container (100) which comprises a regular or irregular polygonal shape. Additionally, a folding tab (202) is attached to said central frame (201) by means of a folding section (203) where the link is located on the exterior side of the central frame (201). At each of its ends, the folding tab (202) integrates a reinforcement tab (204), which is arranged perpendicular to the folding section (203) and to the side of the central frame (201) coincident with the folding section (203). On the other hand, the reinforcement tab (204) is also arranged linearly with respect to the side of the central frame (201) that is perpendicular to the side folding tab (202). When the folding tab (202) is folded, it adheres to the lower part of the top edge (105) of the container (100), arranged linearly with said reinforcement tab (204). In the event that the container (100) has an excess frame on two sides, the arrangement of the reinforcement tab (204) coincide with the lower surface of the central frame (201), which is arranged linearly with said reinforcement tab (204).

II. Independent Reinforcement Frame (200) with External Reinforcement Tabs (205).

According to another embodiment, the independent reinforcement frame (200) comprises a central frame (201) in the form of a frame that integrally directly and indirectly supports the other components of the independent reinforcement frame (200), where the configuration of its internal periphery (201*a*) coincides with the upper part of the periphery of the receiving cavity in the container (100), which comprises a regular or irregular polygonal shape. Additionally, it has a folding tab (202) attached to said central frame (201) by means of a folding section (203), where the link is located on the exterior side of said central frame (201). At each of its ends, the folding tab (202) integrates a reinforcement tab (204), which is arranged perpendicular to the folding section (203) and to the side of the central frame (201) coincident with said folding section (203). On the other hand, the reinforcement tab (204) is also arranged linearly with respect to the side of the central frame (201) that is perpendicular to the side folding tab (202). When the folding tab (202) is folded, it adheres to the lower part of the top edge (105) of the container (100), arranged linearly with said reinforcement tab (204) In the event that the container (100) has an excess frame on two sides, the arrangement of the reinforcement tab (204) coincides with the lower surface of the area where the top edge (105) of a container with an excess frame on four sides is located. Otherwise, it will coincide with the lower part of the central frame (201) on the side where it is arranged in a linear manner, in case the container does not have excess material in the upper part. Additionally, this embodiment of the independent reinforcement frame (200) integrates an external reinforcement tab (205), arranged on the exterior side of the folding tab (202), where said external reinforcement tab (205) is joined to the folding tab by means of an external tab fold (205*a*). This type of arrangement is ideally used for container (100) configurations that are free of surpluses in their upper periphery, where the embodiment of external reinforcement tabs (205) is arranged in such a way that their extension goes from the middle zone of the folding tab (202) to an area near to each of the reinforcement tabs (204) with the external tabs adhering to the external wall of the container (100).

III. Independent Reinforcement Frame (200) with Arrangement of Internal Reinforcement Tabs (206).

According to another embodiment, the independent reinforcement frame (200) comprises a central frame (201) in the form of a frame which integrally directly and indirectly supports the other components of the independent reinforcement frame (200), and where the configuration of its internal periphery (201*a*) coincides with the upper part of the periphery of the receiving cavity in the container (100), which comprises a regular or irregular polygonal shape. Additionally, there is a folding tab (202) attached to said central frame (201) by means of a folding section (203), where the link is located on the exterior side of said central frame (201). At each of its ends, the folding tab (202) integrates a reinforcement tab (204), which is arranged perpendicular to the folding section (203) and to the side of the central frame (201) coincident with said folding section (203). On the other hand, said reinforcement tab (204) is also arranged linearly with respect to the side of the central frame (201) that is perpendicular to the side folding tab (202). When the folding tab (202) is folded, it adheres to the lower part of the top edge (105) of the container (100), arranged linearly with said reinforcement tab (204). In the event that the container (100) has an excess frame on two sides, the arrangement of the folding tab (202) coincide with the lower surface of the area where the top edge (105) is located. Additionally, this embodiment of the independent reinforcement frame (200) integrates an internal reinforcement tab (206), arranged on the internal periphery of the central frame (201) by means of external tab folds (206*a*), oriented or arranged towards the central section within the central frame (201), where each internal reinforcement tab (206) joins the internal wall of the side wall of the container (100). This type of arrangement is ideally used for configurations of containers (100) that are free of surpluses on their upper periphery, with some surplus on their upper part, or with surpluses on all their sides and where said internal reinforcement tabs (206) have a configuration with reductions in their angles, preferably beveled reductions that promote the generation of angles between connection tabs.

IV. Independent Reinforcement Frame (200) with Both External (205) and Internal (206) Reinforcement Tabs.

According to another embodiment, the independent reinforcement frame (200) comprises a central frame (201) that integrally supports both directly and indirectly the other components of the reinforcement frame (200) and where the configuration of its internal periphery (201*a*) coincides with the upper part of the periphery of the receiving cavity in the container (100) which comprises a regular or irregular polygonal shape. Additionally, there is a folding tab (202) attached to said central frame (201) by means of a folding section (203), where the link is located on the exterior side of said central frame (201). At each of its ends, the folding tab (202) integrates a reinforcement tab (204), which is arranged perpendicular to the folding section (203) and to the side of the central frame (201) coincident with said folding section (203). On the other hand, said reinforcement tab (204) is also arranged linearly with respect to the side of the central frame (201) that is perpendicular to the side folding tab (202). When the reinforcement tab (204) is folded, it adheres to the lower part of the top edge (105) of the container (100), arranged linearly with said reinforcement tab (204). In the event that the container (100) has an excess frame on two sides, the arrangement of the reinforcement tab (204) coincides with the lower surface of the top edge (105) area. On the other hand, when the container does not have excess material on the sides, the reinforcement tab (204) adheres to the lower part of the central frame (201) in a linear arrangement. Additionally, when the folding tab (202) is fixed, it coincides with the lower surface of the area where the top edge (105) is located.

Additionally, this embodiment of the reinforcement frame (200) integrates an external reinforcement tab (205) arranged on the exterior side of the folding tab (202), where said external reinforcement tab (205) is joined to the folding tab (202) by means of an external tab fold (205*a*). This type of arrangement is ideally used for container (100) configurations that are free of surpluses in their upper periphery, where the external reinforcement tabs (205) are arranged so that their extension spans from the middle section of the folding tab (202) to an area close to each of the reinforcement tabs (204). This embodiment of the reinforcement frame (200) integrates an internal reinforcement tab (206), positioned on the internal side of the central frame (201), parallel to the folding tab (202), where said internal reinforcement tab (206) joins the internal wall of the side wall of the container (100) by means of a fold (206*a*). This type of arrangement is ideally used for container (100) configurations that are free of surpluses in their upper periphery, with some surplus at the upper part, or with surpluses on all sides. In this case, the internal reinforcement tabs (206) are arranged in such a way that their extension spans from the middle area of the folding tab (202) to an area close to each of the reinforcement tabs (204).

Even in an alternative embodiment of the independent reinforcement frame (200), it can incorporate a sectioning (201*b*) in the upper and lower parts of the reinforcement frame, particularly on the sides or portions that are free of the folding tab (202). In this way, the incorporation of the folding tab (202) with its respective reinforcement tabs (204) can be achieved with a reduction in the amount of material to lower costs. This sectioning or cutting can have a straight or diagonal direction, as well as regular and irregular shapes, as long as the sectioning results in a reduction of material in the linear area with respect to the folding tab (204).

V. Independent Reinforcement Frame Free of Folding Tabs (202).

According to another embodiment, the independent reinforcement frame (200) is free of folding tabs (202), where said reinforcement frame (200) only comprises the central frame (201) and is positioned at the top part of the container (100) adhering to the reinforcement tabs (204) arranged within the container (100). This union forms the complete independent reinforcement frame structure. As the preform of the container (100) now includes the folding tab (202), the reinforcement frame (200) free of tabs has an internal periphery (201*a*) that coincides with the cavity of the container (100).

In one embodiment of the invention, the reinforcement tab (204) has a configuration that is symmetrical with the adjacent apex portion of the central frame (201) where it is positioned.

In another embodiment of the invention, the reinforcement tab (204) has a configuration with reduced symmetry relative to the shape of the adjacent vertex of the central frame (201) where it is positioned.

In another embodiment of the invention, the reinforcement tab (204) has a configuration without symmetry relative to the shape of the adjacent vertex of the central frame (201) where it t is positioned, but in any case, maintaining an extension/dimension/magnitude of measurements that does not exceed (when folded) the limits established by the shape of the adjacent vertex of the central frame (201) where it is positioned.

For the shape of the reinforcement tab (204) illustrated in FIGS. 23-58 and FIGS. 61-89, it can be observed that rounded profiles are present, although these could also refer to straight shapes, variable angular shapes, rounding arrangements, irregular figures, among others, as shown in the embodiments illustrated in FIGS. 59-61 provided that the arrangement of the reinforcement tab (204) is preserved in the same way as in the aforementioned embodiments. This is because the reinforcement is achieved by folding the reinforcement tab (204) where it reaches (when folded) an adhesion portion that extends to a lower plane of the adjacent linear side of the container (100), either joining the bottom of an excess profile of the container (100) or with the lower surface of the central frame (201).

The container (100) defines a frame adapted to receive the reinforcement frame (200). It must be considered, however, that in the present invention the fixing means used for the rigid union of the upper part of the container with the reinforcement frame are not limited to the adhesive elements mentioned above.

Preferably, although not exclusively, some of the aforementioned elements of the reinforcement frame (200) have fins bent at an angle, attached, and joined to the rest of the elements of the central frame (201) and to the lateral folding tabs (202).

Preferably, but not exclusively, there is a container arrangement with an independent reinforcement frame where the container (100) has an excess arrangement with the incorporation of the reinforcement tabs (204). Ideally, in this embodiment of the invention, the container (100) is generally of conventional construction, comprising a bottom wall (101) of regular or irregular polygonal shape that has a plurality of edges (102), wherein a sidewall (103) extends upwardly from each edge (102), while a plurality of adjacent sidewalls (104) are connected between the sidewalls (103). Additionally, each sidewall (103) has a top edge (105), which is foldable and has a horizontal configuration when the container (100) is assembled. A closure flap (106) is connected in an articulate manner to the upper edge of each side wall, such that the closure flaps (106) can be folded inwardly or outwardly relative to the container (100) to form a closing arrangement. In a preferred embodiment of this container, it is integrated into each of the adjacent sidewalls (104) a secondary upper edge (107), which is likewise foldable to achieve a fixation through an adhesive medium that joins it with the top edge (105), so that said secondary upper edge (107) also has a horizontal configuration once the container is assembled. Furthermore, there is a folding tab (202) adjacent to each top edge (105), where said union is promoted by means of a folding section (203), with said link being located on the exterior side of said top edge (105)). At each of its ends, the folding tab (202) integrates a reinforcement tab (204), which is arranged perpendicularly to the folding section (203) and to the side of the top edge (105) that is coincident with said folding section (203)). On the other hand, said reinforcement tab (204), is also arranged linearly with respect to the side of the top edge (105) that is perpendicular to the lateral folding tab (202). When the folding tab (202) is folded, it adheres to the lower part of the reinforcement frame (200) which is free of adhesion tabs and that is placed on the upper part of the container.

VI. Independent Reinforcement Frame (200) Free of Folding Tabs (202).

In the aforementioned embodiment, there is a reinforcement frame (200) which is free of folding tabs (202), where said frame is only made up of the central frame (201) and is placed in the upper part of the container (100) maintaining adhesion with the reinforcement tabs (204) of the container This union generates the complete independent reinforcement frame structure as the preform of the container (100) now includes the folding tab (202) components.

In the same embodiment mentioned above, there is a reinforcement frame (200) which is free of folding tabs (202), where said frame is only made up of the central frame (201), which has a sectioning (201*d*) arranged on one of the sides of said frame, promoting the incorporation of a two-part frame. Said frame (201) is placed in the upper part of the container (100) maintaining adhesion with the reinforcement tabs (204) of the container This union generates the complete independent reinforcement frame structure, as the preform of the container (100) now has the folding tab (202) components.

In these last two embodiments, it is contemplated that the central frame structure (201) either in its continuous or separate section, is joined or adhered with the folding tabs (202) and the reinforcement tab (204) belonging to the main container, from either the upper or lower plane of the reinforcement frame, that is, through either the top or bottom of it.

Derived from the integration of any of the container (100) embodiments with the reinforcement frame (200), containers with an independent reinforcement frame can be manufactured using thinner material and/or alternative materials compared to conventional methods. Conventional methods typically use thicker materials including paper, cardboard, corrugated cardboard, and container board. As a result, a variety of materials can be used to form the structure of the container and reinforcement frame in the present disclosure. This provides the user with a broader selection of materials to manufacture the container, whose strength is equivalent to or greater than that of existing solutions. This is primarily due to the arrangement of the fibers in the materials, when combined with the container and frame and an adhesive medium, have a perpendicular orientation that enhances the overall strength of the container. Consequently, this approach leads to a less expensive product, with less material and more environmentally friendly.

Although sometimes referred to herein as a brace frame container representing an apparatus according to embodiments of the present invention, it is not restricted to any particular application or use.

In one embodiment of the container with an independent reinforcement frame, separation elements are provided, where a plurality of adjacent rows or columns are placed, adapted to a portion of the lower part or bottom of the container and to the walls of each of these, also defining such elements as dividers. These dividers can be arranged in the form of adjoining containers.

For this, separator containers have been used, made with cardboard sheets that are inserted into holes arranged in the walls of the container and at the bottom of it.

It is an object of the present invention to provide a heat-sealed cover that can be mounted on a container or on the independent reinforcement frame, which allows liquids to be contained within the container.

It is an object of the present invention to provide a thermoformed cover that can be mounted on a container or on the independent reinforcement frame allowing liquids to be contained in the container.

It is an object of the present invention to provide or include modified atmosphere packaging where a film liner is incorporated into the body of the container with independent reinforcement frame wherein said modified atmosphere packaging maintains the freshness and attractiveness of the packaged products during use by modifying the gas surrounding the packaged product. This modification of the atmosphere is intended to improve the visual appearance, texture, and nutritional appeal of the food stored in the container.

It is still an additional object of the invention, in view of the disadvantages that could arise from the absence of a cover that blocks access to the interior of the container Said cover is attached to the independent reinforcement frame, making it continuous with the same structure. Additionally, the material that forms the cover is sourced from the same material that was previously sectioned to create the hole defining the independent reinforcement frame. This also incorporates a cover for the general body of the container, where a storage box cover is provided, which can pivot open from one of the internal, external sides, or even from internal accesses within the cover, as will be further explained in subsequent paragraphs.

In an alternative embodiment of the independent reinforcement frame (200), it is ideally made up of a single continuous piece, comprising a central frame (201) which integrally supports the other components of the independent reinforcement frame (200). The configuration of its internal periphery (201*a*) is ideally coincident with, although it may not coincide with, the upper part of the periphery of the receiving cavity in the container (100), which comprises a regular or irregular polygonal shape. Additionally, there are a plurality of receiving cavities (201*c*), which serve as receiving means for a plurality of joining means (210) of a lid (208). Furthermore, there is a folding tab (202) attached to said central frame (201) by means of a folding section (203), where the link is located in the exterior side of said central frame (201). At each of its ends, the folding tab (202) integrates a reinforcement tab (204), which is arranged perpendicular to the folding section (203) and to the side of the central frame (201) coincident with said folding section (203). On the other hand, said reinforcement tab (204) is also arranged linearly with respect to the side of the central frame (201) that is perpendicular to the side folding tab (202). When the folding tab (202) is folded, it adheres to the lower part of the top edge (105) of the container (100), arranged linearly with said reinforcement tab (204). In the event that the container (100) has an excess frame on two sides, the arrangement of the reinforcement tab (204) coincides with the lower surface of the central frame (201), which is arranged linearly with said reinforcement tab (204). Furthermore, this embodiment of the independent reinforcement frame (200) integrates a lid (208), which is obtained from the same material as the independent reinforcement frame (200). In previous embodiments this portion (the lid (208)) is removed and discarded, however, in this embodiment it is intended to provide a closing/blocking means towards the interior of the container, without resulting in additional or production costs. More importantly, it does not interfere with the strength provided by the independent reinforcement frame (200). This lid (208) is supported by one side of the internal periphery (201*a*) of the independent reinforcement frame (200) by means of a lid fold (209). The lid (208) also includes a plurality of joining means (210) that protrude from the its body and are embedded in the receiving cavities (201*c*) present in the central frame (201). This arrangement allows for the initial blocking or restriction of access to the interior of the container, with the receiving cavities (201*c*) and joining means (210) joined by adhesive means, adhesive materials, breakable seals, mechanical locks (such as staples or snaps), hook and loop closures, or even temporary closures, using magnetic or self-adhesive materials that allow repetitive attachment and separation of both elements. In this embodiment of the invention, the joining means (210) protrude with a semicircular portion, however, any regular or irregular geometric shape that meets the criteria of being an extension of the lid (208) is also considered.

The aforementioned embodiment that mentions the first embodiment of the incorporation of the lid (208) can be seen in FIGS. 101, 102, 107 and 108 However, it is also applicable for containers with more or fewer sides.

In an alternative embodiment, the lid (208) has a lid fold (209) that coincides with the folding section (203) of the central frame (201), as seen in FIGS. 103, 104, 109 and 110. This embodiment is used for containers with a larger or wider input capacity.

In another embodiment of the lid (208), the lid fold (209) coincides with a central portion of the external periphery of one of the sides of the central frame (201). This arrangement includes an extension (209*a*) that extends from the internal periphery (201*a*) of the central frame, to an area close to the folding section (203) as seen in FIGS. 105, 106, 111 and 112.

In the same sense, there is also a pair of fastening tabs (211) incorporated in each of the sides perpendicular to the folding tabs (202) in an additional embodiment of the invention, as can be seen in FIGS. 103, 104, 105, 106, 109, 110, 111, 112, 113, 114, 115, 116.

In an alternative embodiment of the lid (208), it has the lid fold (209) incorporated in any of the sides perpendicular to the folding tabs (202) as can be seen in FIGS. 113, 114, 115 and 116.

Figure 1:
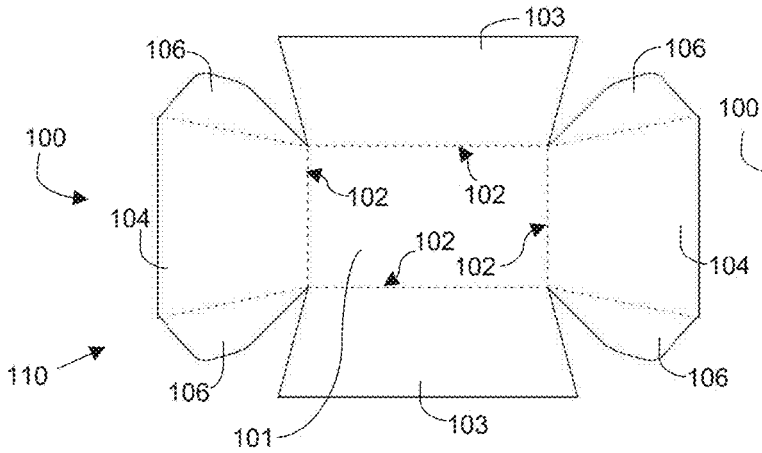
FIG. 1 shows a top view of a planar arrangement of one embodiment of the container (100).
Figure 2:
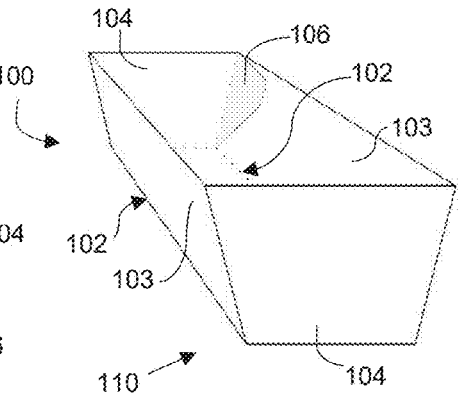
FIG. 2 shows an isometric view of one embodiment of the container (100).
Figure 3:
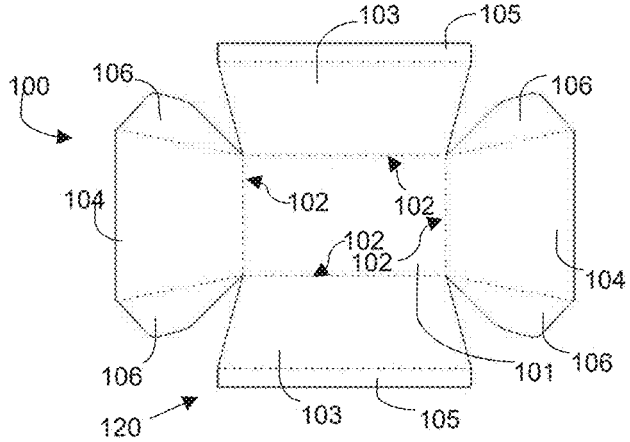
FIG. 3 shows a top view of a planar arrangement of one embodiment of the container (100).
Figure 4:
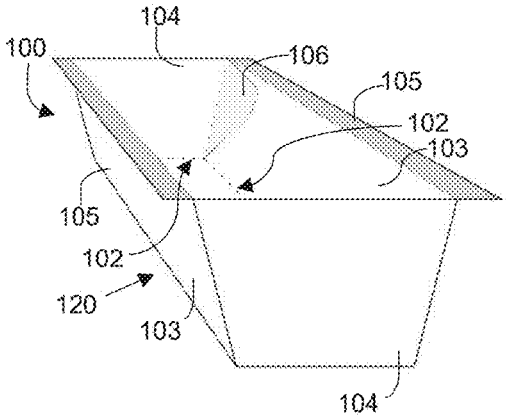
FIG. 4 shows an isometric view of one embodiment of the container (100).
Figure 5:
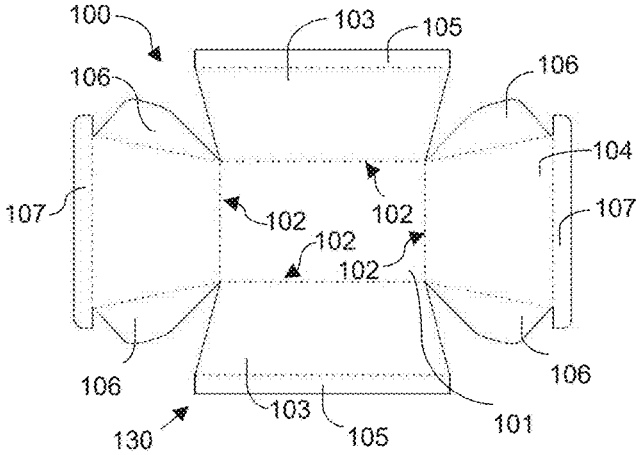
FIG. 5 shows a top view of a planar arrangement of one embodiment of the container (100).
Figure 6:
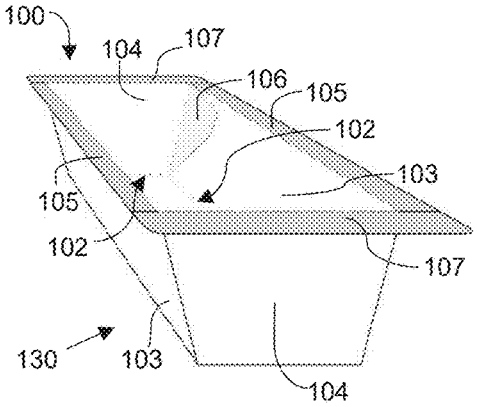
FIG. 6 shows an isometric view of one embodiment of the container (100).
Figure 7:
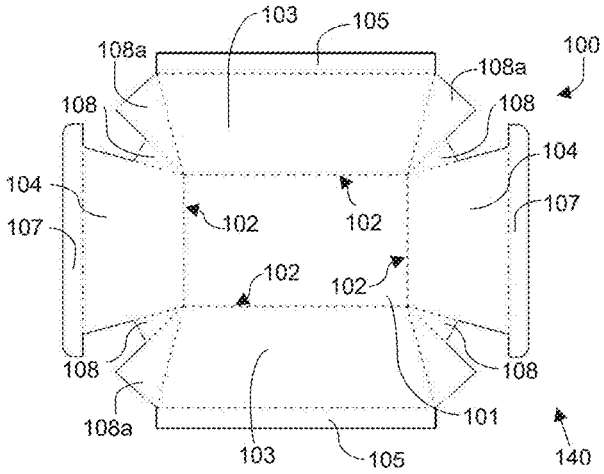
FIG. 7 shows a top view of a planar arrangement of one embodiment of the container (100).
Figure 8:
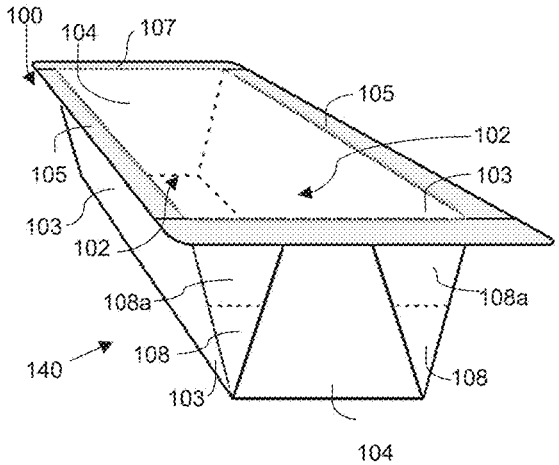
FIG. 8 shows an isometric view of one embodiment of the container (100).
Figure 9:
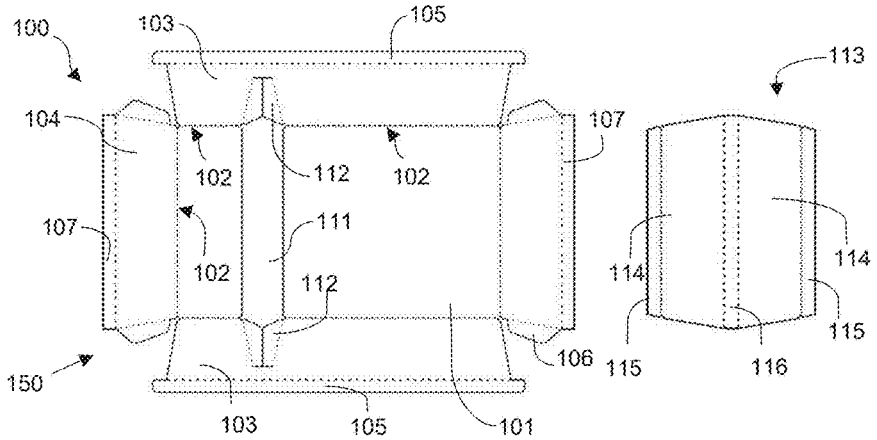
FIG. 9 shows a top view of one embodiment of the container (100).
Figure 10:
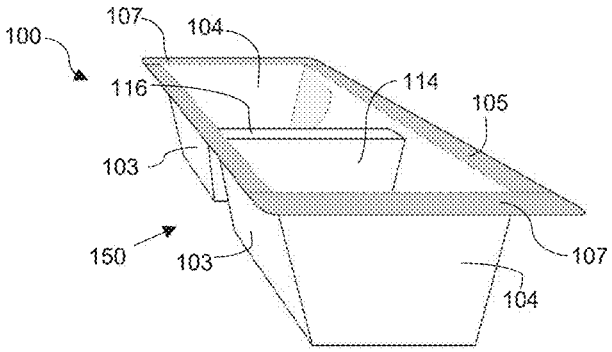
FIG. 10 shows an isometric view of one embodiment of the container (100).
Figure 11:
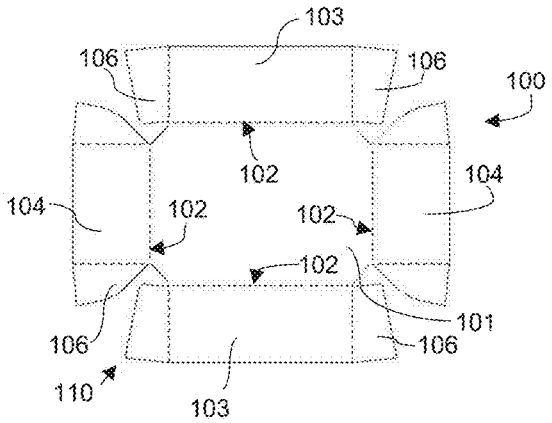
FIG. 11 shows a top view of an embodiment of the container (100) with separator.
Figure 12:
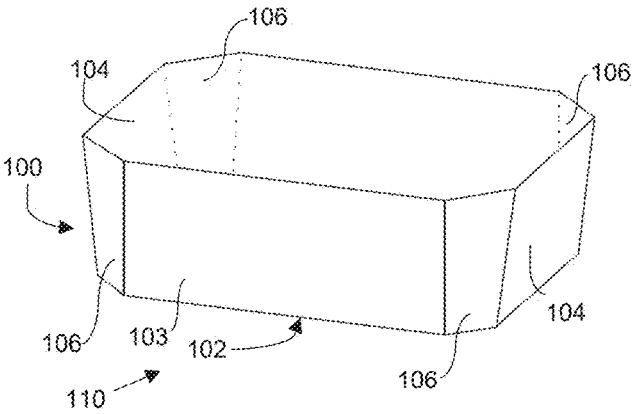
FIG. 12 shows an isometric view of one embodiment of the container (100).
Figure 13:
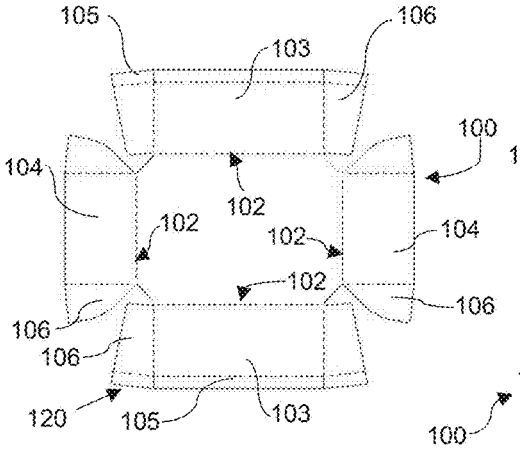
FIG. 13 shows a top view of a planar arrangement of one embodiment of the container (100).
Figure 14:
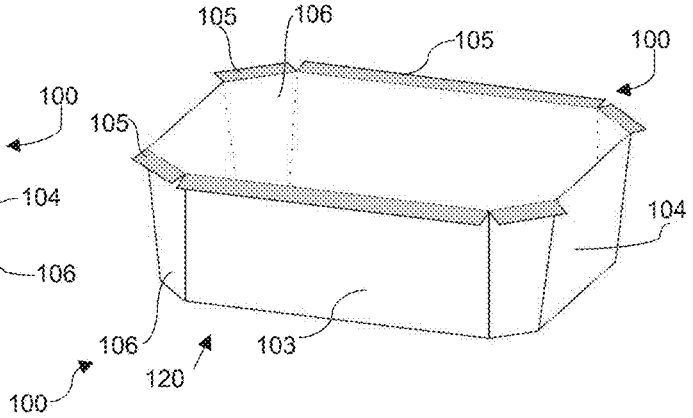
FIG. 14 shows an isometric view of one embodiment of the container (100).
Figure 15:
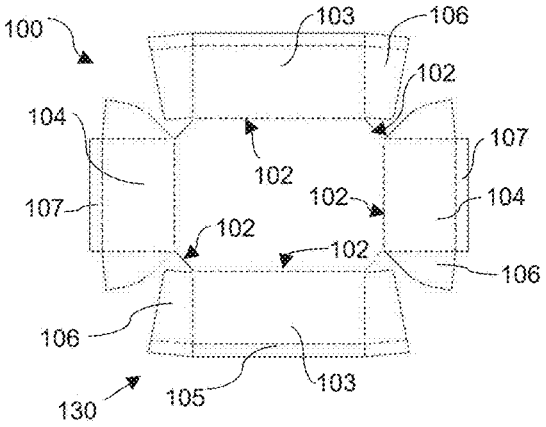
FIG. 15 shows a top view of a planar arrangement of one embodiment of the container (100).
Figure 16:
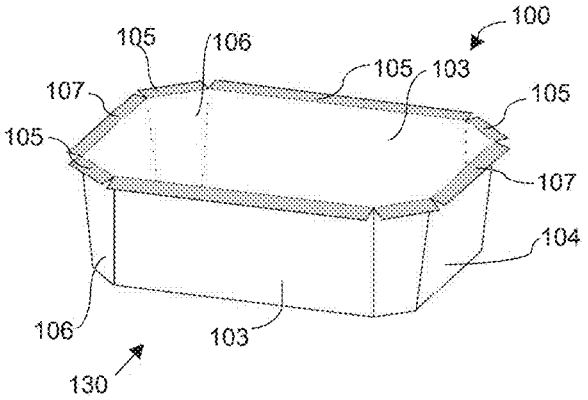
FIG. 16 shows an isometric view of one embodiment of the container (100).
Figure 17:
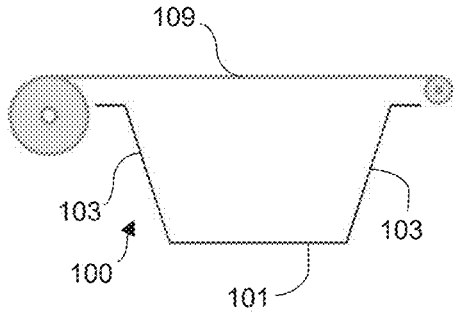
FIG. 17 shows a side view of an embodiment of the container (100) with a thermoformed film (109).
Figure 18:
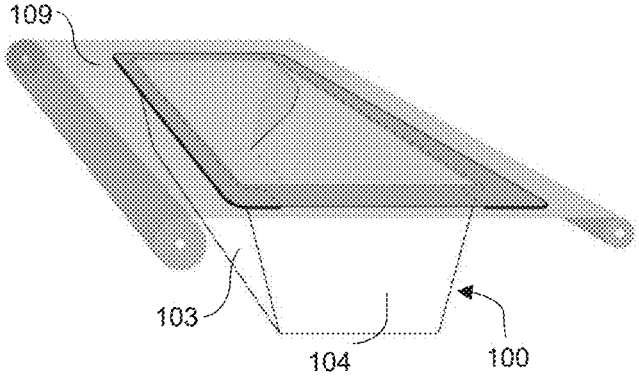
FIG. 18 shows an isometric view of an embodiment of the container (100) with a thermoformed film (109).
Figure 19:
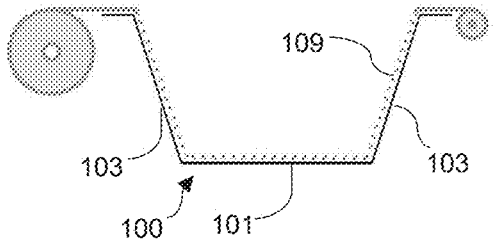
FIG. 19 shows a side view of an embodiment of the container (100) with a thermoformed film (109).
Figure 20:
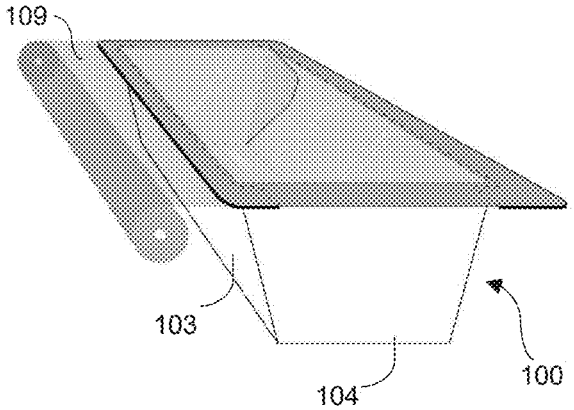
FIG. 20 shows an isometric view of an embodiment of the container (100) with a thermoformed film (109).
Figure 21:
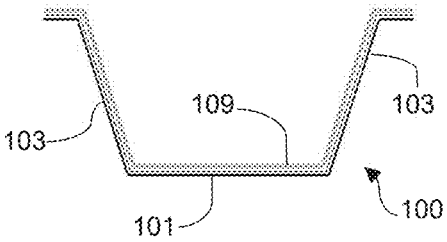
FIG. 21 shows a side view of an embodiment of the container (100) with a thermoformed film (109).
Figure 22:
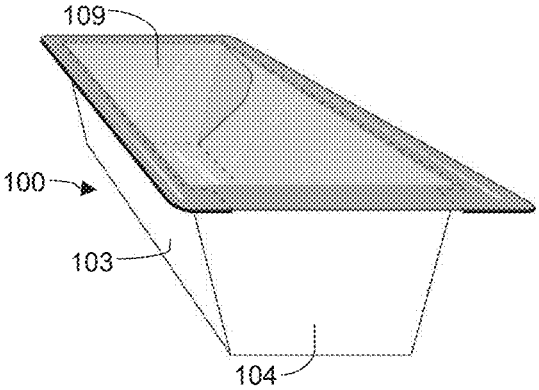
FIG. 22 shows an isometric view of an embodiment of the container (100) with a thermoformed film (109).
Figure 25:
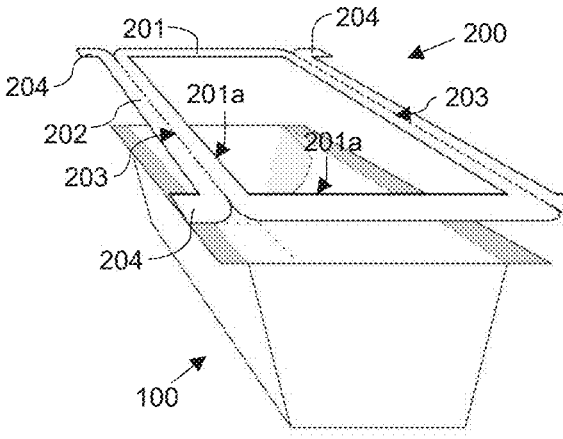
FIG. 25 shows an exploded isometric view of the container (100) with independent reinforcement frame (200).
Figure 26:
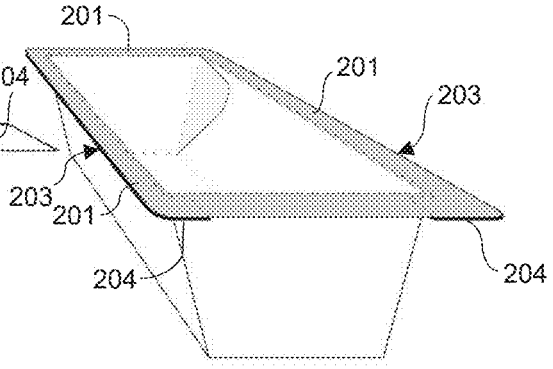
FIG. 26 shows an isometric view of the container (100) with independent reinforcement frame (200).
Figure 27:
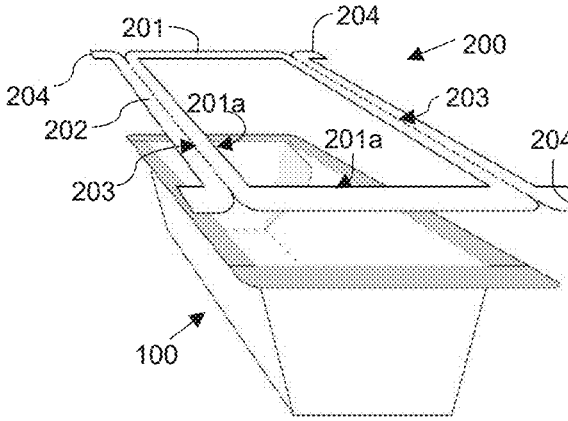
FIG. 27 shows an exploded isometric view of the container (100) with independent reinforcement frame (200).
Figure 28:
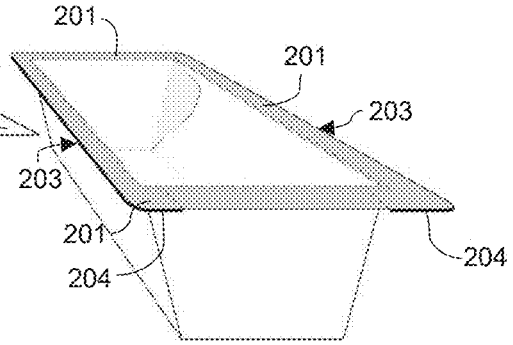
FIG. 28 shows an isometric view of the container (100) with independent reinforcement frame (200).
Figure 33:
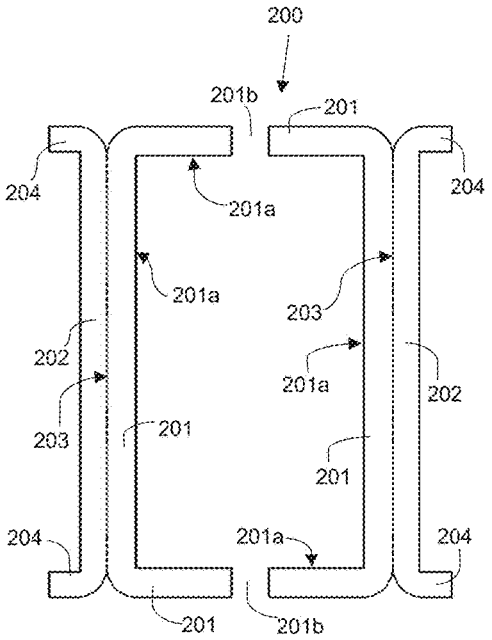
FIG. 33 shows a top view of a planar arrangement of one embodiment of the reinforcement frame (200).
Figure 34:
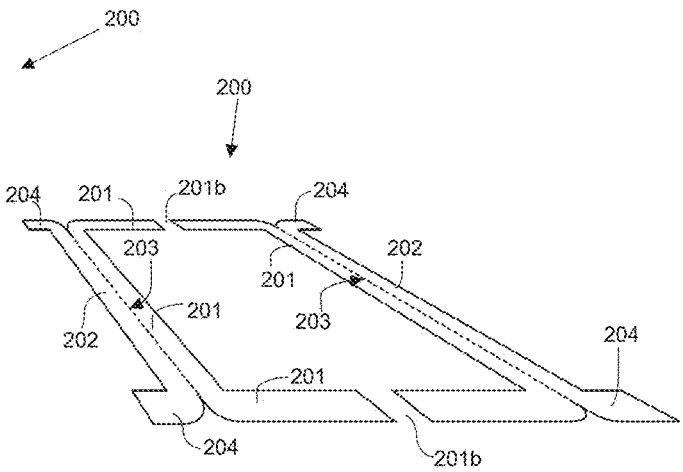
FIG. 34 shows an isometric view of an embodiment of the reinforcement frame (200).
Figure 35:
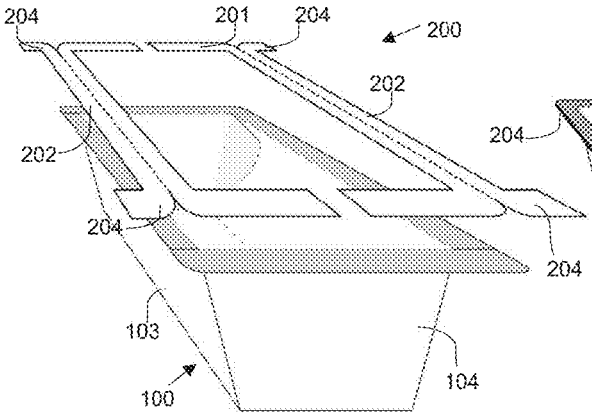
FIG. 35 shows an exploded isometric view of the container (100) with independent reinforcement frame (200).
Figure 36:
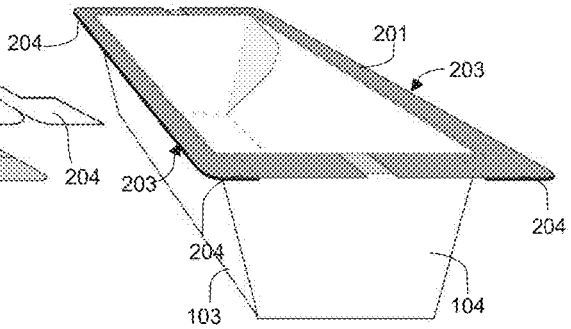
FIG. 36 shows an isometric view of the container (100) with independent reinforcement frame (200).
Figure 37:
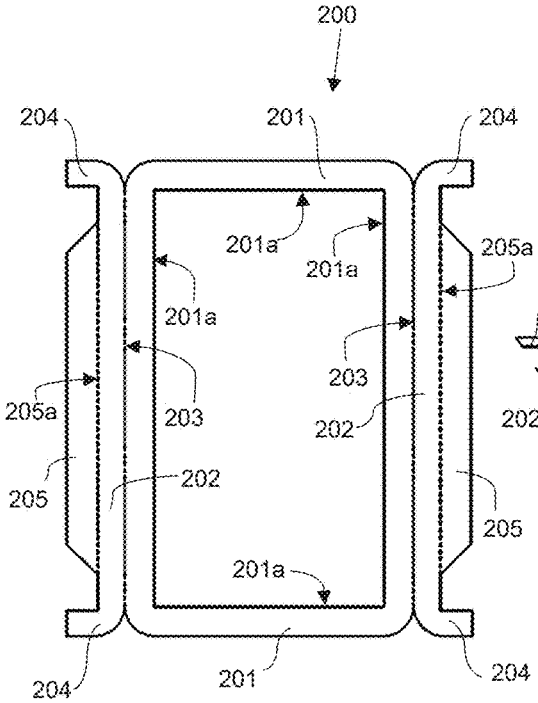
FIG. 37 shows a top view of a planar arrangement of one embodiment of the reinforcement frame (200).
Figure 38:
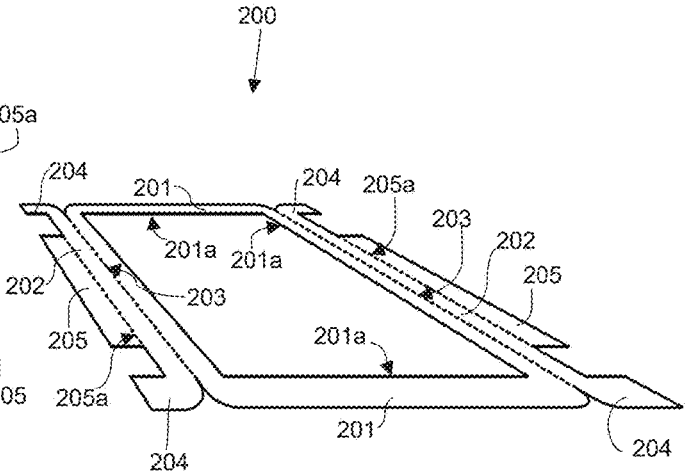
FIG. 38 shows an isometric view of an embodiment of the reinforcement frame (200).
Figure 43:
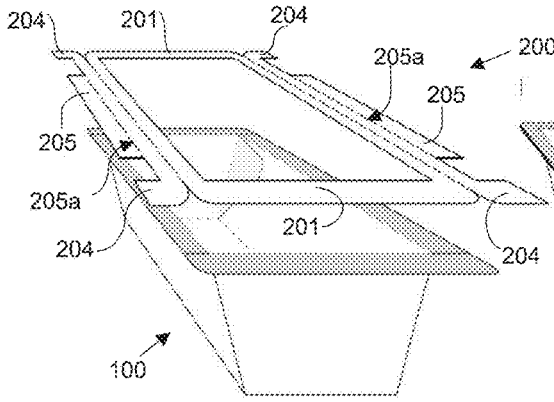
FIG. 43 shows an exploded isometric view of the container (100) with independent reinforcement frame (200).
Figure 44:
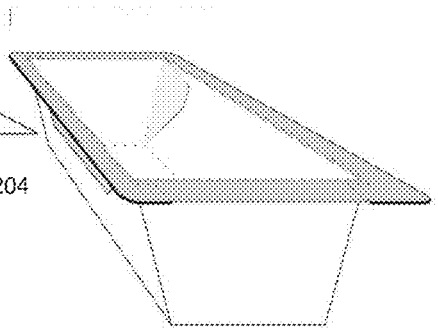
FIG. 44 shows an isometric view of the container (100) with independent reinforcement frame (200).
Figure 45:
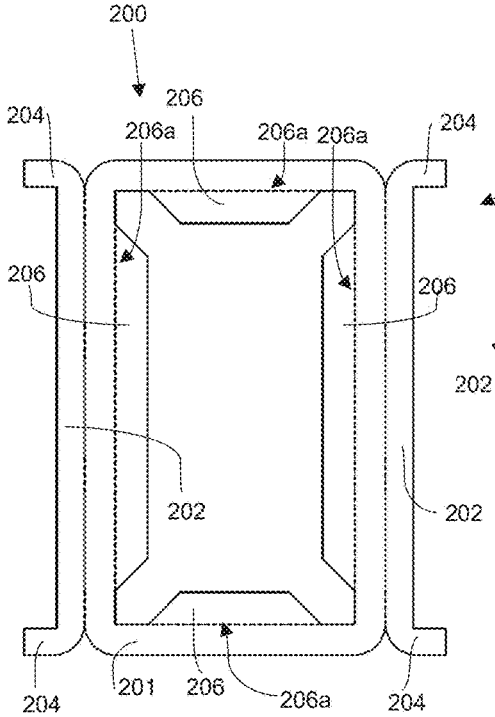
FIG. 45 shows a top view of a planar arrangement of one embodiment of the reinforcement frame (200).
Figure 46:
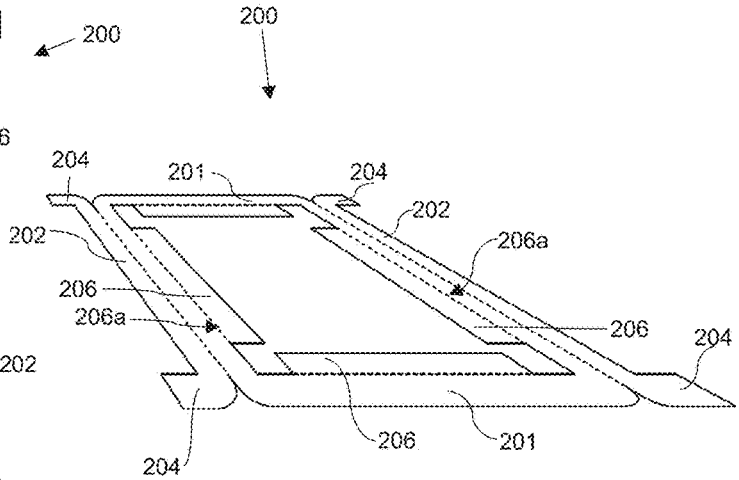
FIG. 46 shows an isometric view of an embodiment of the reinforcement frame (200).
Figure 47:
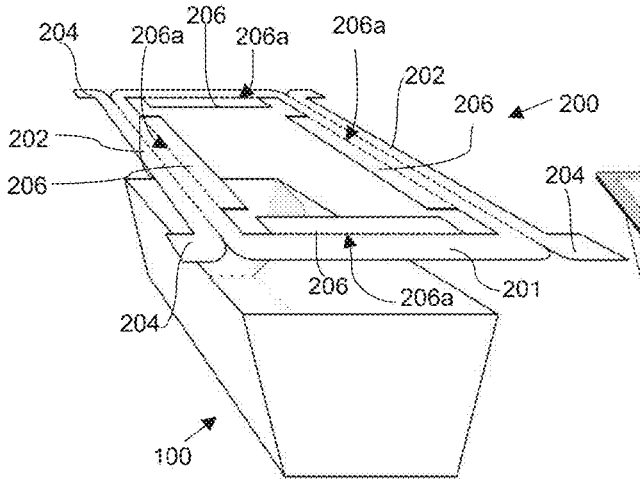
FIG. 47 shows an exploded isometric view of the container (100) with independent reinforcement frame (200).
Figure 48:
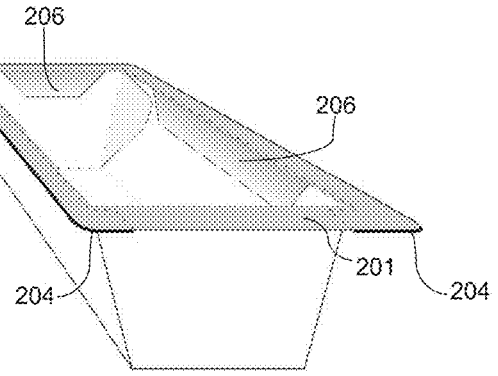
FIG. 48 shows an isometric view of the container (100) with independent reinforcement frame (200).
Figure 49:
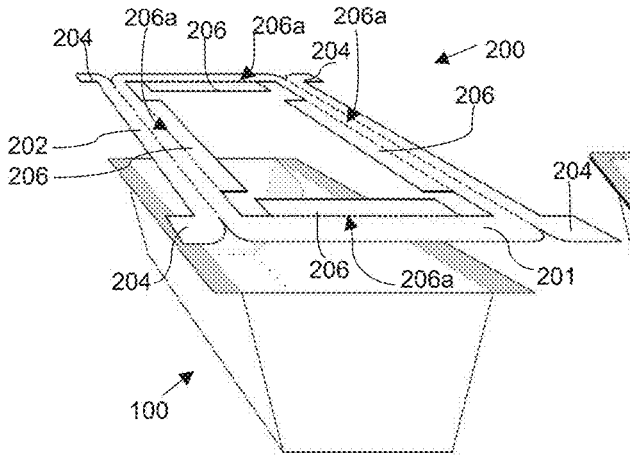
FIG. 49 shows an exploded isometric view of the container (100) with independent reinforcement frame (200).
Figure 50:
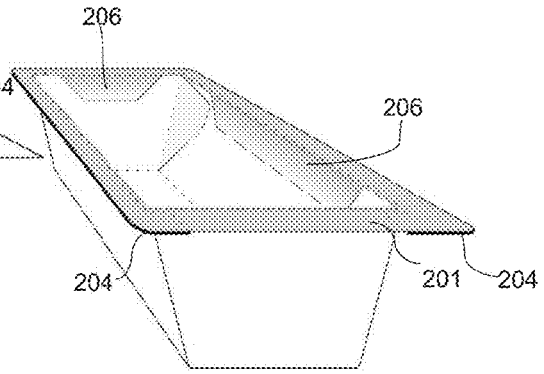
FIG. 50 shows an isometric view of the container (100) with independent reinforcement frame (200).
Figure 51:
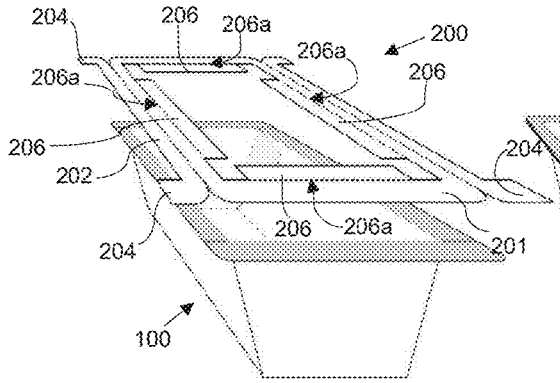
FIG. 51 shows an exploded isometric view of the container (100) with independent reinforcement frame (200).
Figure 52:
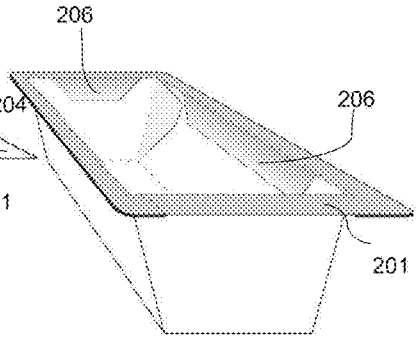
FIG. 52 shows an isometric view of the container (100) with independent reinforcement frame (200).
Figure 53:
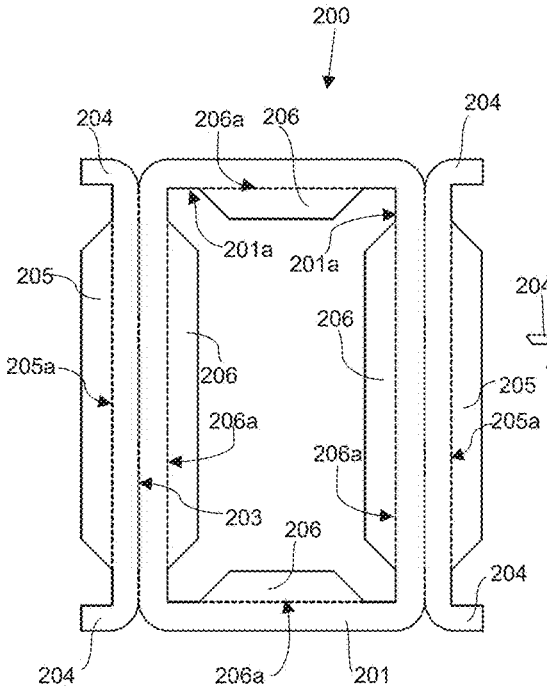
FIG. 53 shows a top view of a planar arrangement of one embodiment of the reinforcement frame (200).
Figure 54:
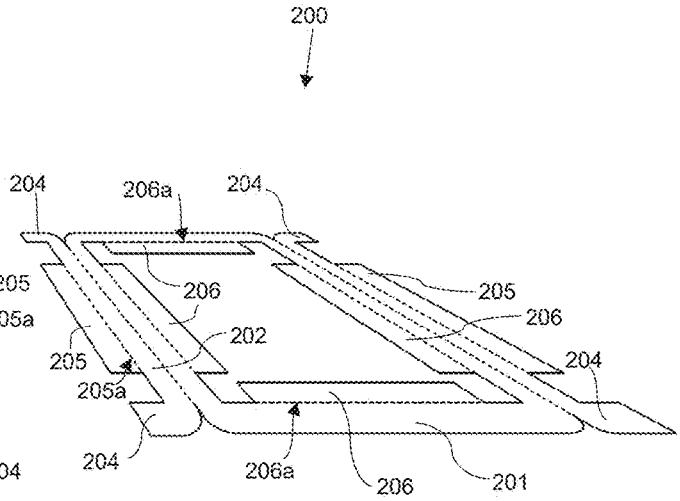
FIG. 54 shows an isometric view of an embodiment of the reinforcement frame (200).
Figure 68:
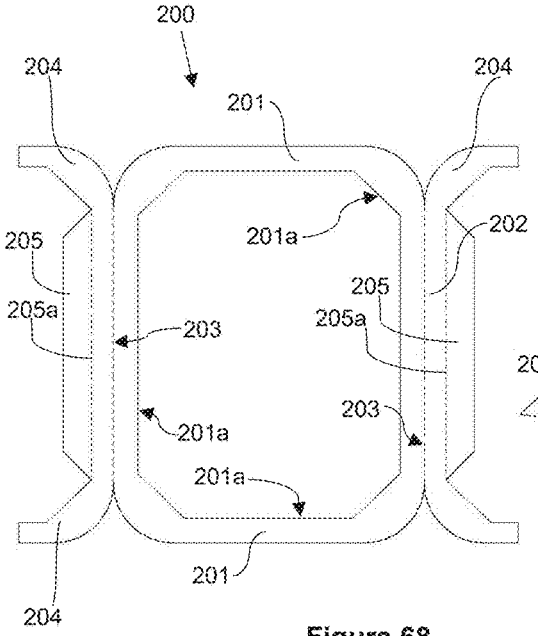
FIG. 68 shows a top view of a planar arrangement of one embodiment of the reinforcement frame (200).
Figure 69:
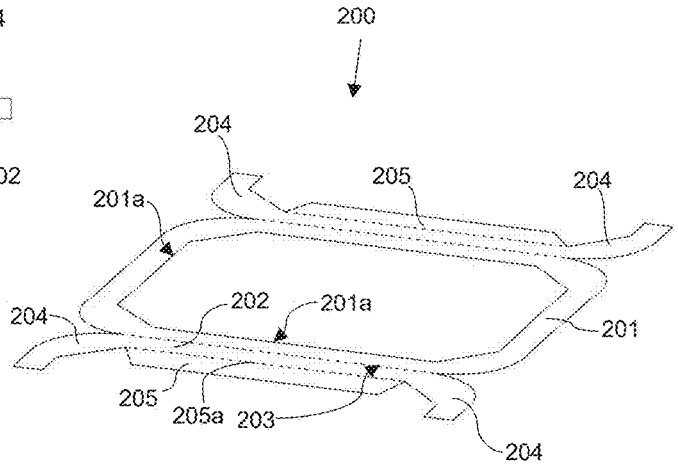
FIG. 69 shows an isometric view of an embodiment of the reinforcement frame (200).
Figure 76:
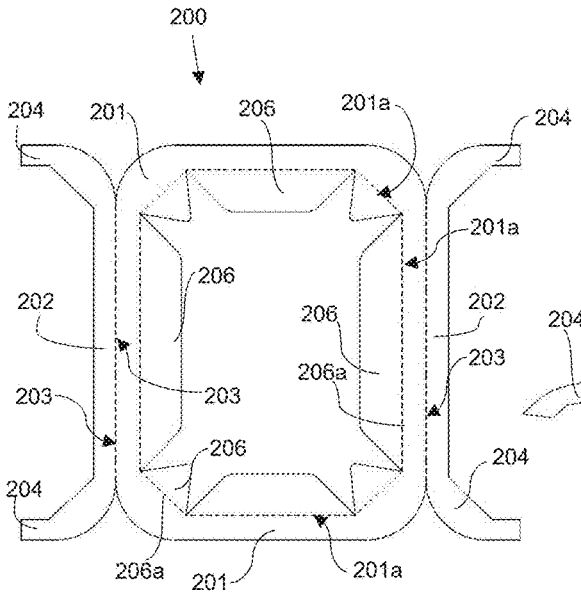
FIG. 76 shows a top view of a planar arrangement of one embodiment of the reinforcement frame (200).
Figure 77:
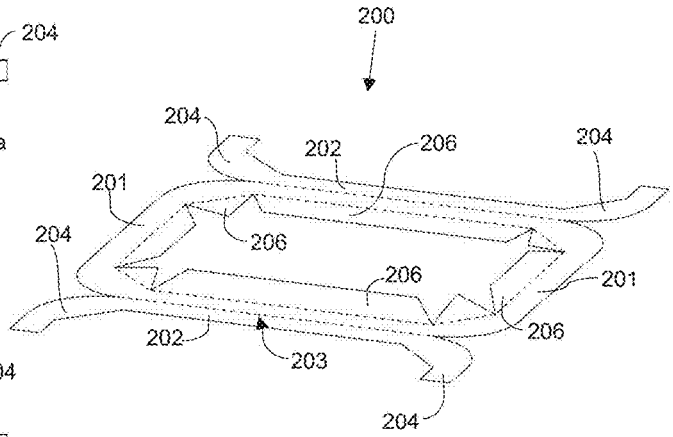
FIG. 77 shows an isometric view of an embodiment of the reinforcement frame (200).
Figure 78:
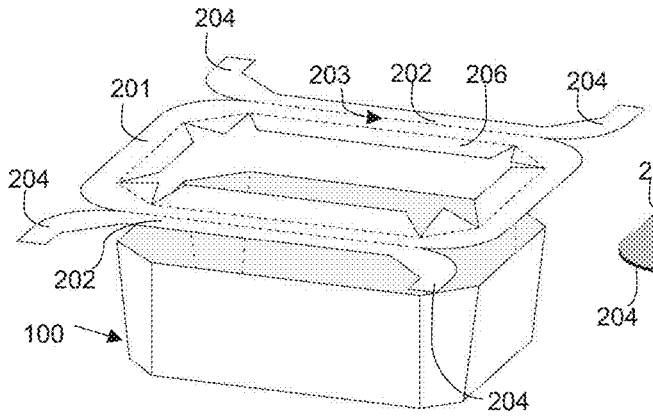
FIG. 78 shows an exploded isometric view of the container (100) with independent reinforcement frame (200).
Figure 79:
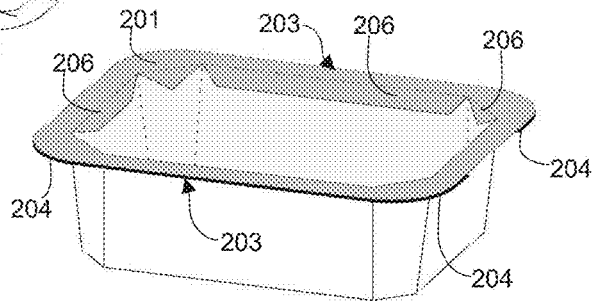
FIG. 79 shows an isometric view of the container (100) with independent reinforcement frame (200).
Figure 80:
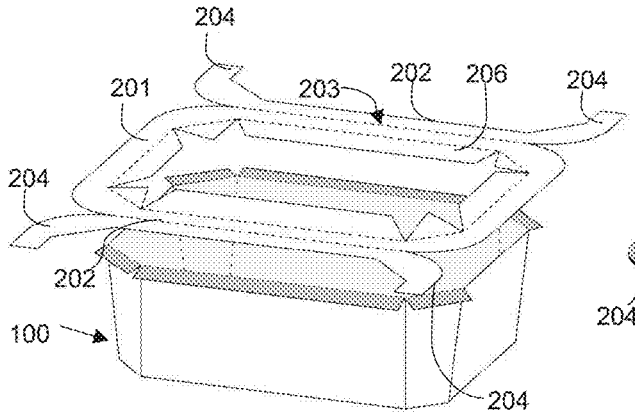
FIG. 80 shows an exploded isometric view of the container (100) with independent reinforcement frame (200).
Figure 81:
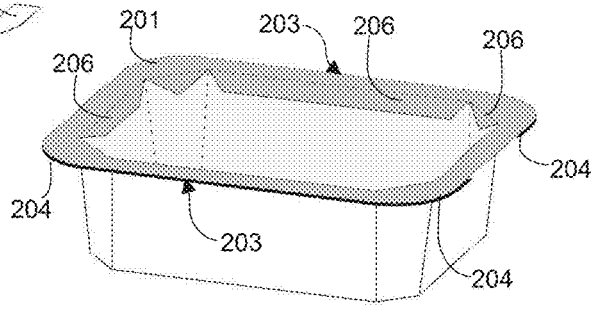
FIG. 81 shows an isometric view of the container (100) with independent reinforcement frame (200).
Figure 82:
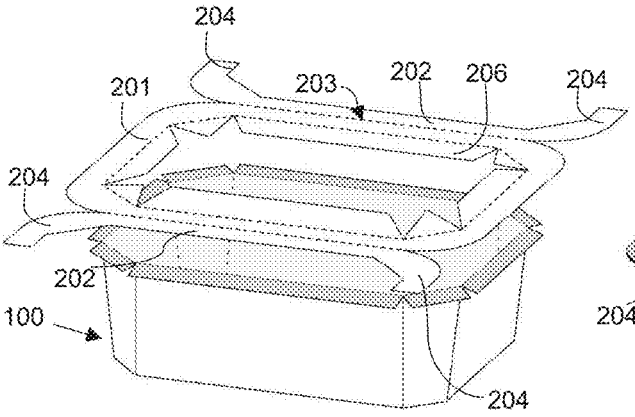
FIG. 82 shows an exploded isometric view of the container (100) with independent reinforcement frame (200).
Figure 83:
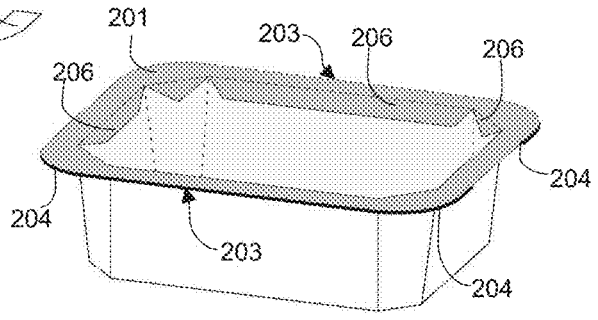
FIG. 83 shows an isometric view of the container (100) with independent reinforcement frame (200).
Figure 84:
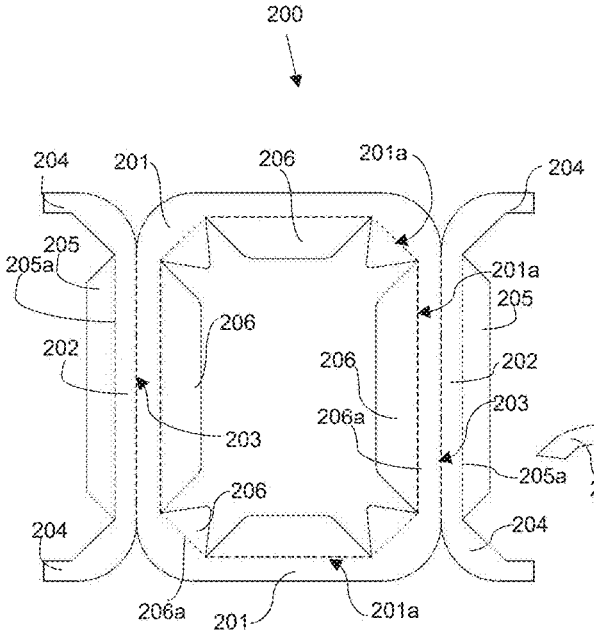
FIG. 84 shows a top view of the independent reinforcement frame (200).
Figure 85:
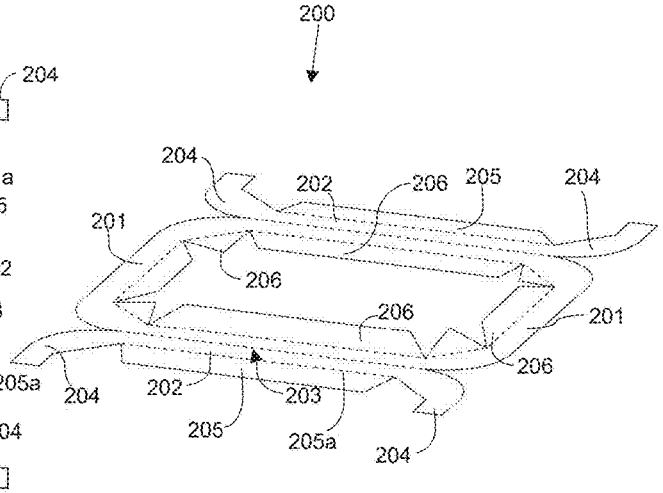
FIG. 85 shows an isometric view of the independent reinforcement frame (200).
Figure 86:
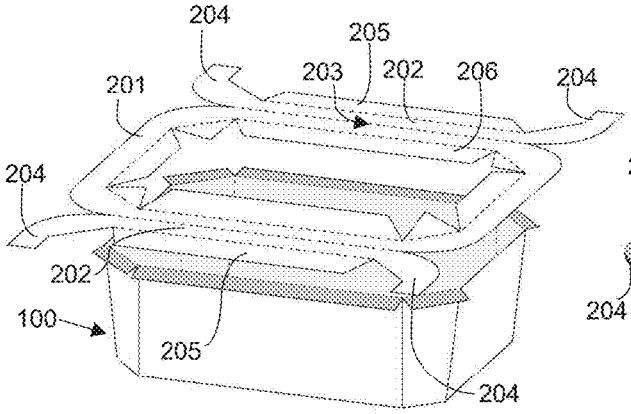
FIG. 86 shows an exploded isometric view of the container (100) with independent reinforcement frame (200).
Figure 87:
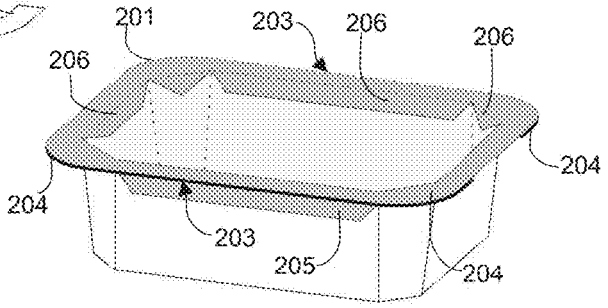
FIG. 87 shows an isometric view of the container (100) with independent reinforcement frame (200).
Figure 88:
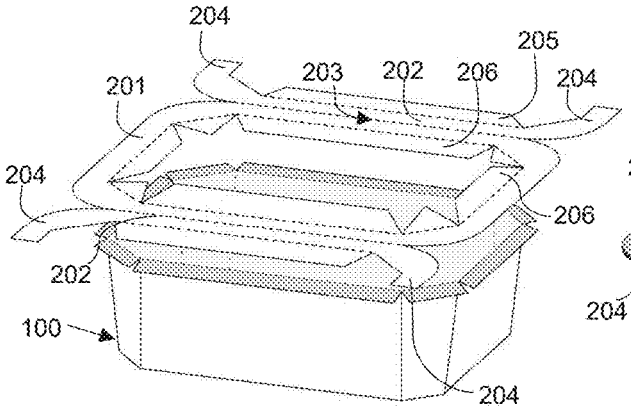
FIG. 88 shows an exploded isometric view of an embodiment of the reinforcement frame (200).
Figure 89:
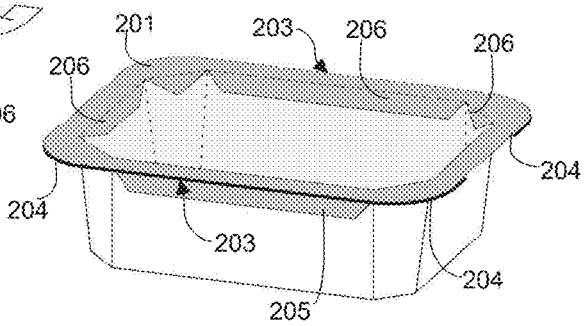
FIG. 89 shows an isometric view of the container (100) with independent reinforcement frame (200).
Figure 90:
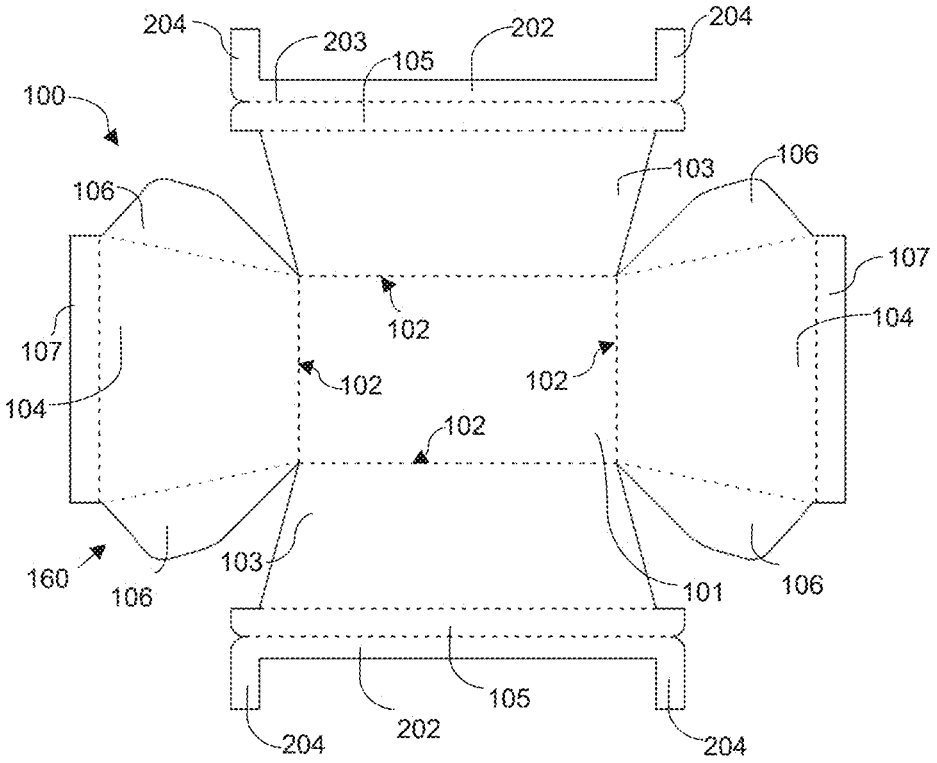
FIG. 90 shows a top view of a planar arrangement of an embodiment of the container (100).
Figure 91:
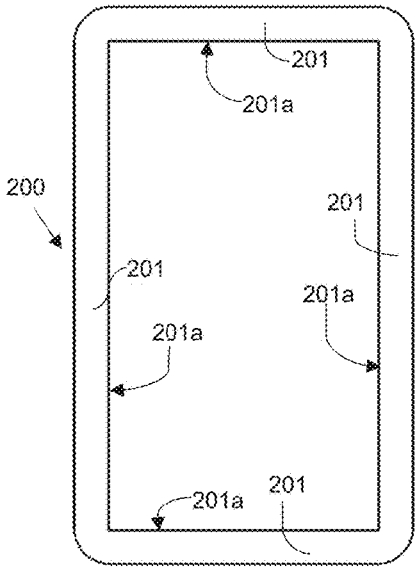
FIG. 91 shows a top view of an embodiment of the reinforcement frame (200).
Figure 92:
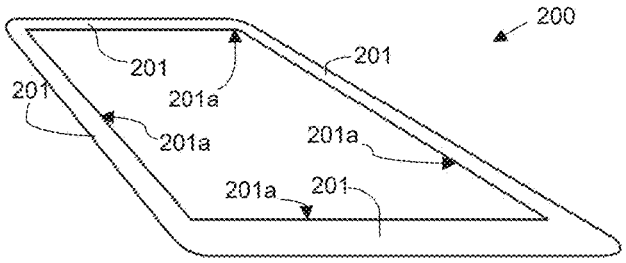
FIG. 92 shows an isometric view of an embodiment of the reinforcement frame (200).
Figure 93:
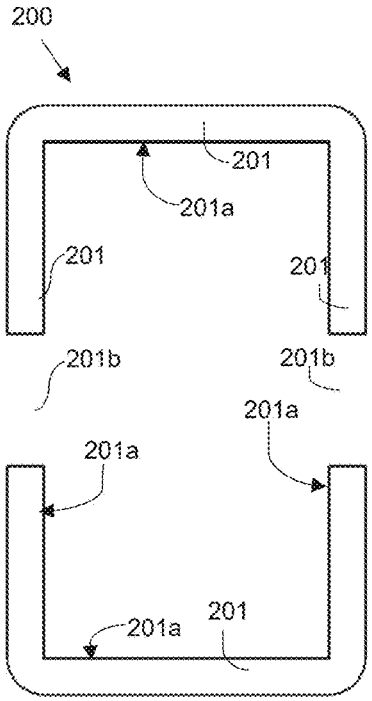
FIG. 93 shows a top view of an embodiment of the reinforcement frame (200).
Figure 94:
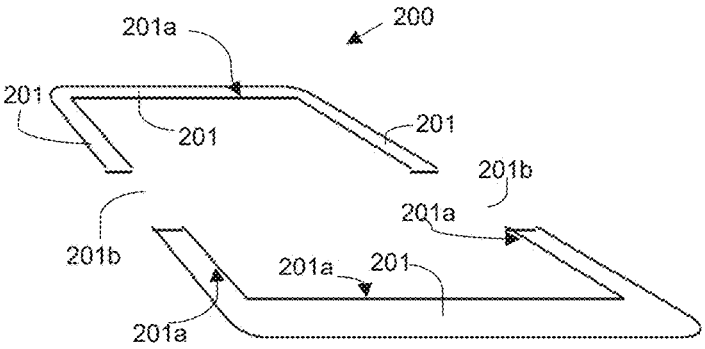
FIG. 94 shows an isometric view of an embodiment of the reinforcement frame (200).
Figure 95:
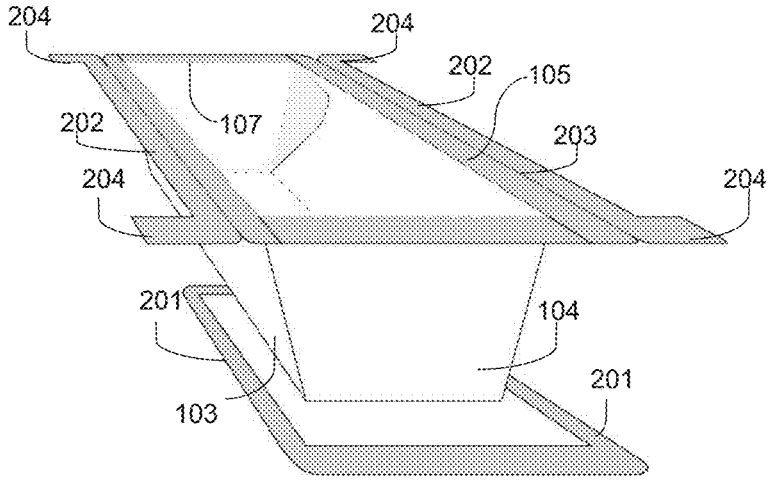
FIG. 95 shows an exploded isometric view of the container (100) with independent reinforcement frame (200).
Figure 96:
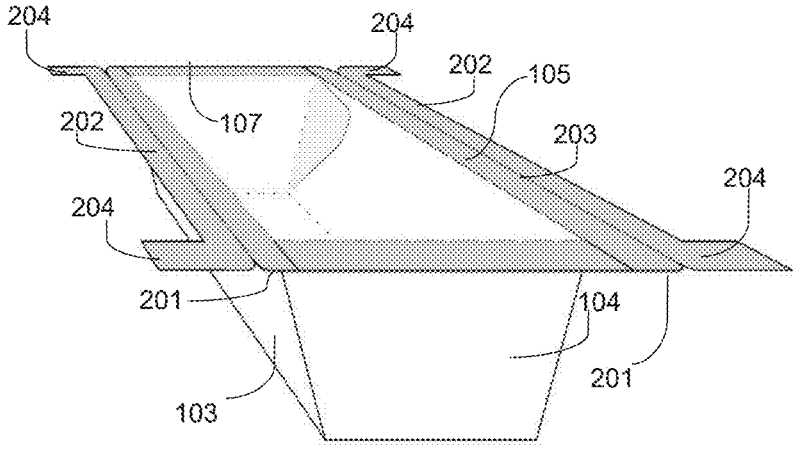
FIG. 96 shows an exploded isometric view of the container (100) with independent reinforcement frame (200).
Figure 97:
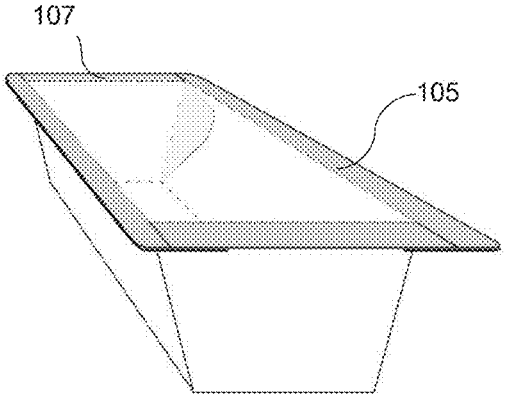
FIG. 97 shows an isometric view of the container (100) with independent reinforcement frame (200).
Figure 98:
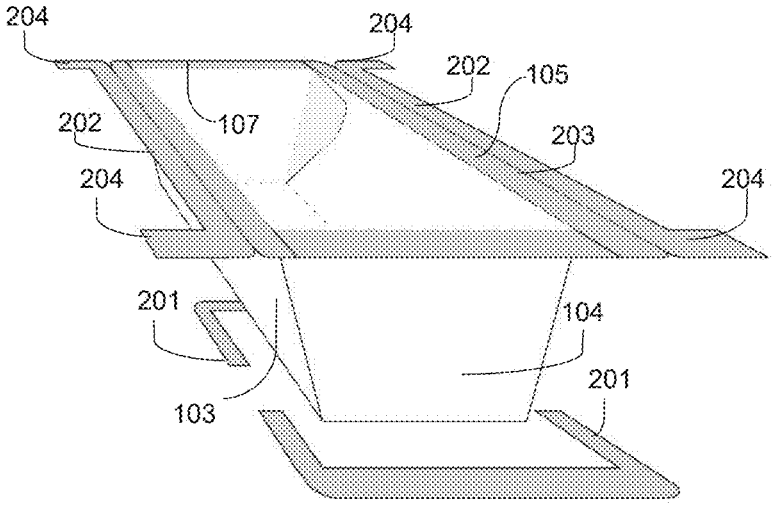
FIG. 98 shows an exploded isometric view of the container (100) with independent reinforcement frame (200).
Figure 99:
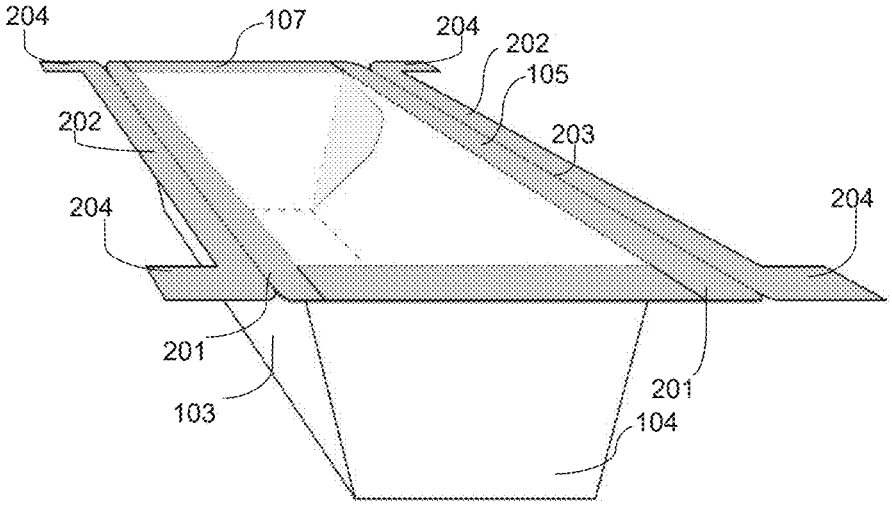
FIG. 99 shows an exploded isometric view of the container (100) with independent reinforcement frame (200).
Figure 100:
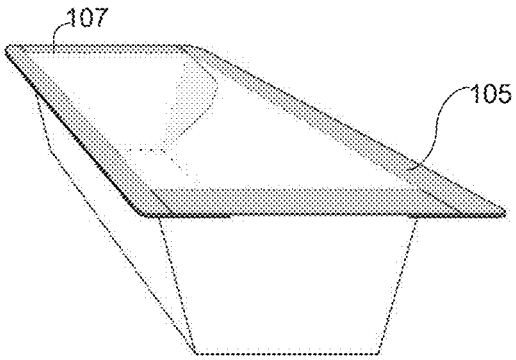
FIG. 100 shows an isometric view of the container (100) with independent reinforcement frame (200).
Figure 101:
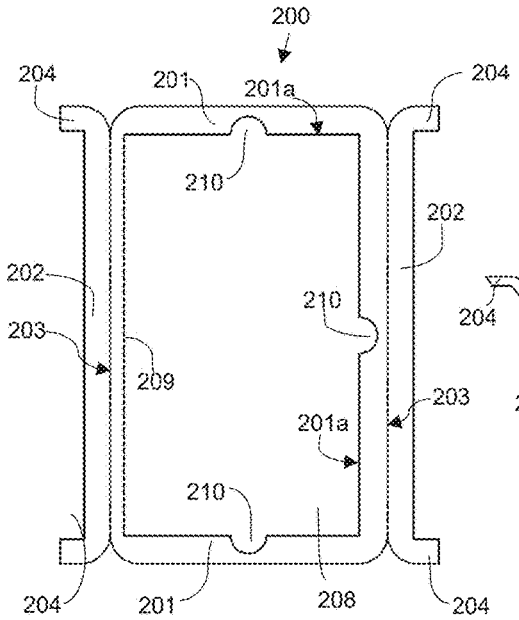
FIG. 101 shows a top view of the independent reinforcement frame (200).
Figure 102:
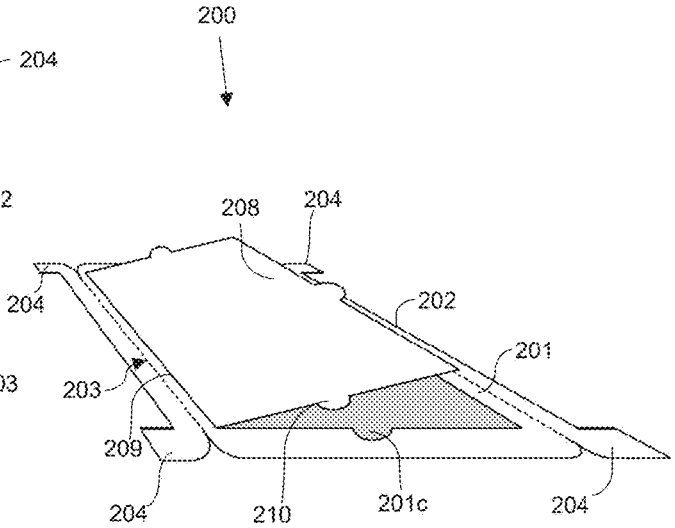
FIG. 102 shows an isometric view of the independent reinforcement frame (200) with a lid (208).
Figure 103:
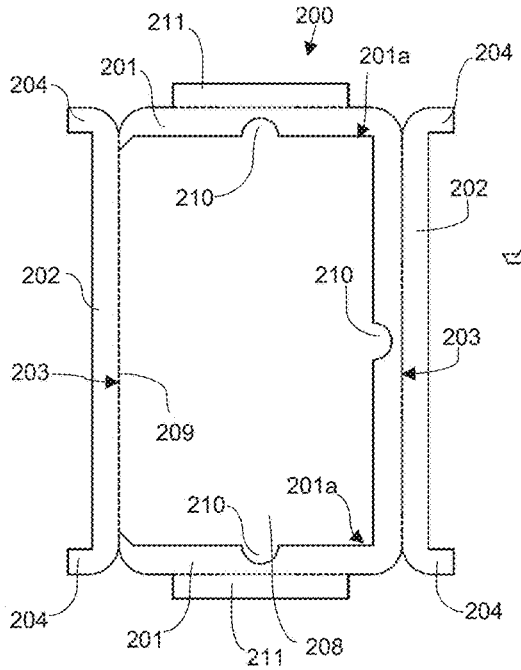
FIG. 103 shows a top view of the independent reinforcement frame (200).
Figure 104:
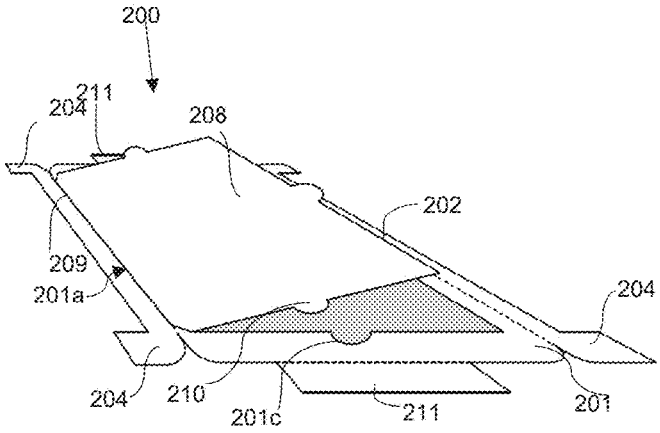
FIG. 104 shows an isometric view of the independent reinforcement frame (200).
Figure 105:
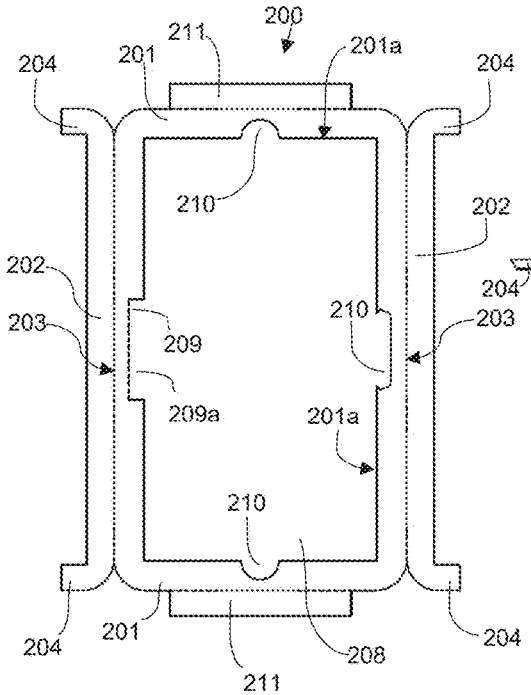
FIG. 105 shows a top view of the independent reinforcement frame (200).
Figure 106:
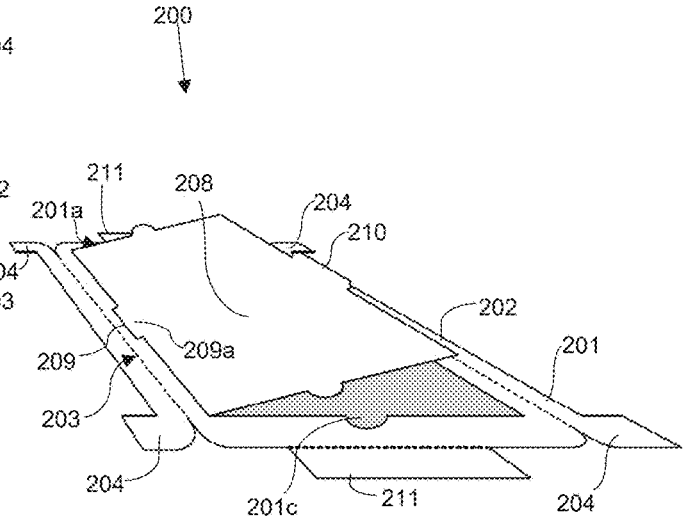
FIG. 106 shows an isometric view of the independent reinforcement frame (200).
Figure 107:
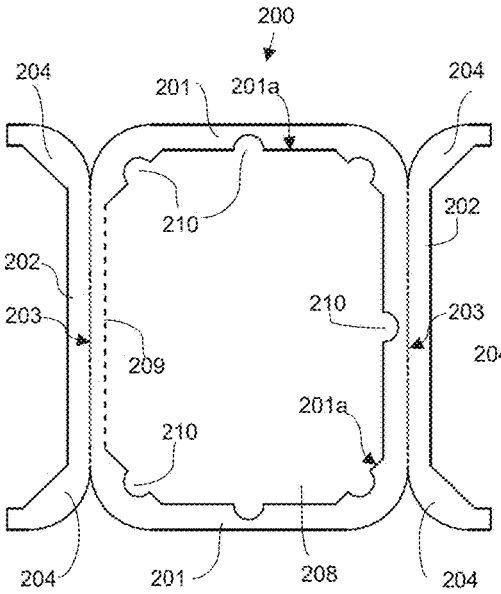
FIG. 107 shows a top view of the independent reinforcement frame (200).
Figure 108:
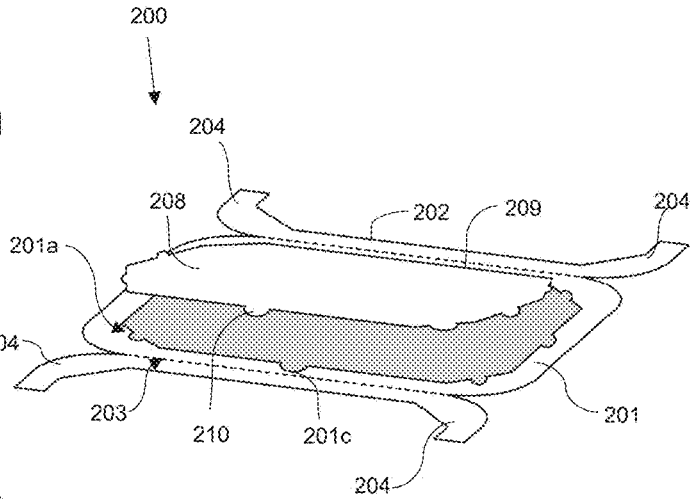
FIG. 108 shows an isometric view of the independent reinforcement frame (200).
Figure 109:
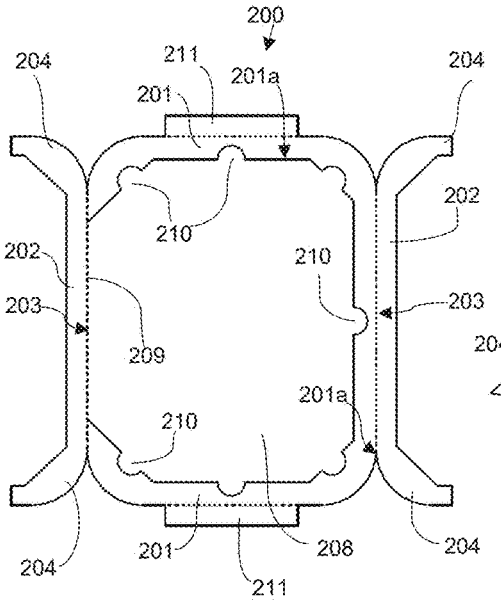
FIG. 109 shows a top view of the independent reinforcement frame (200).
Figure 110:
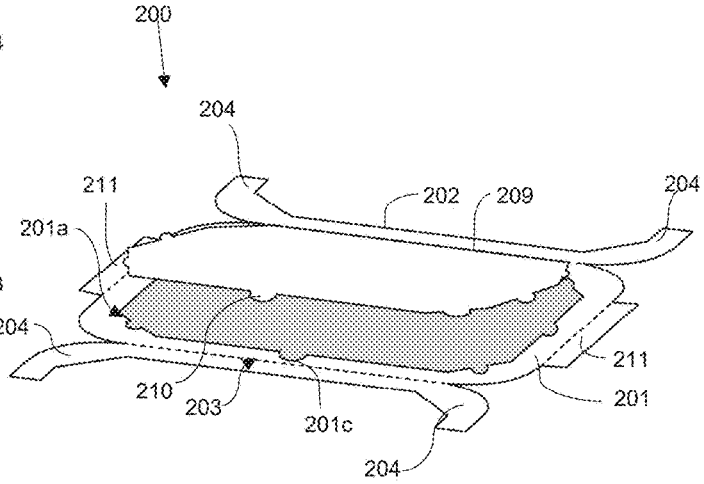
FIG. 110 shows an isometric view of the independent reinforcement frame (200).
Figure 111:
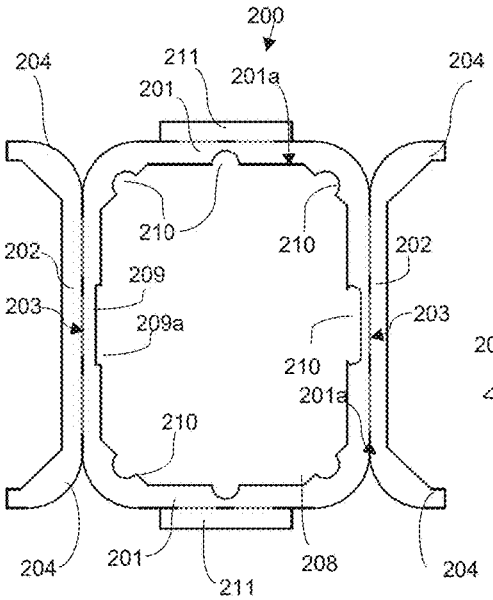
FIG. 111 shows a top view of the independent reinforcement frame (200).
Figure 112:
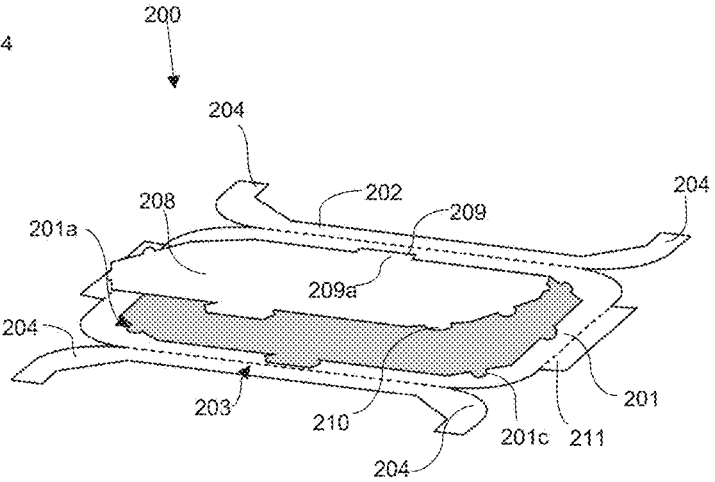
FIG. 112 shows an isometric view of the independent reinforcement frame (200).
Figure 113:
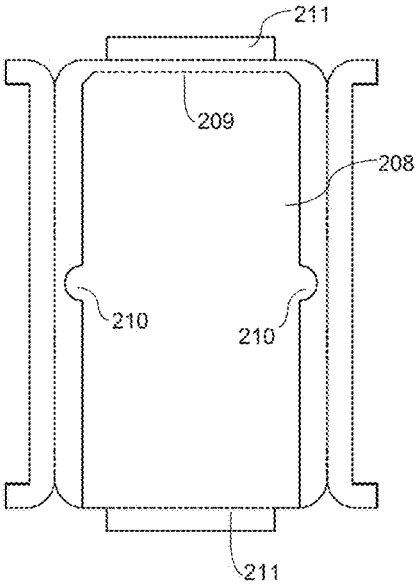
FIG. 113 shows a top view of the independent reinforcement frame (200).
Figure 114:
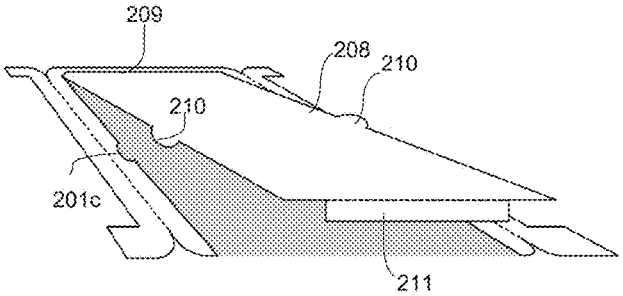
FIG. 114 shows an isometric view of the independent reinforcement frame (200).
Figure 115:
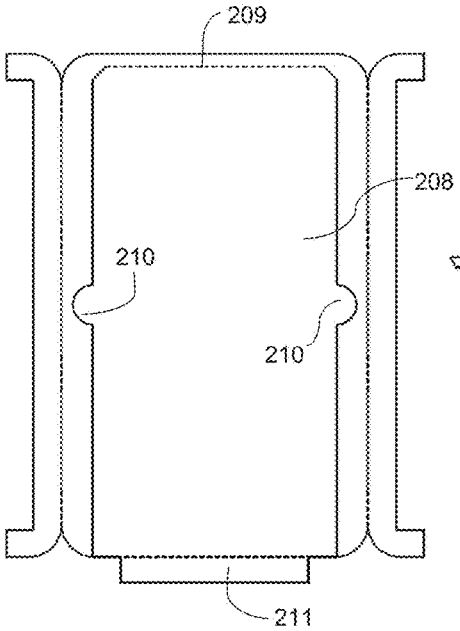
FIG. 115 shows a top view of the independent reinforcement frame (200).
Figure 116:
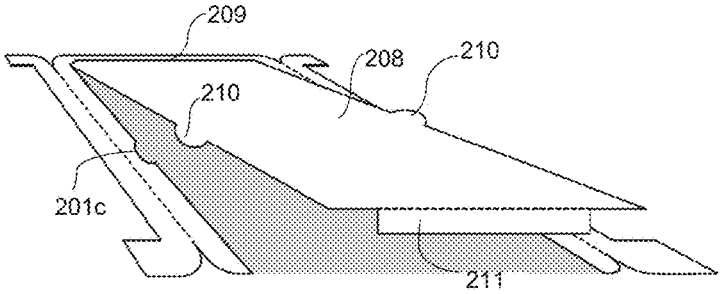
FIG. 116 shows an isometric view of the independent reinforcement frame (200).
Figure 117:
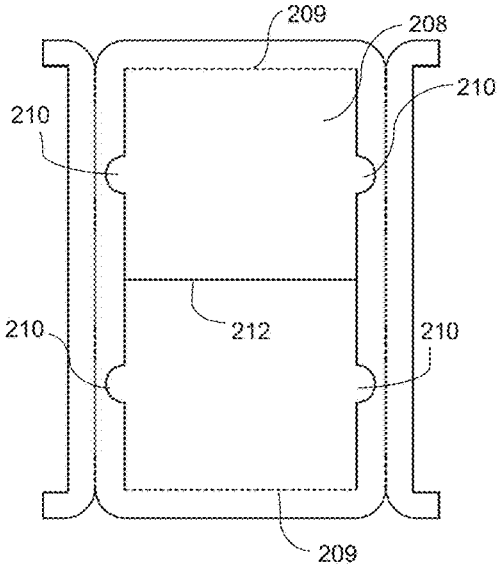
FIG. 117 shows a top view of the secondary reinforcement arrangement (300).
Figure 118:
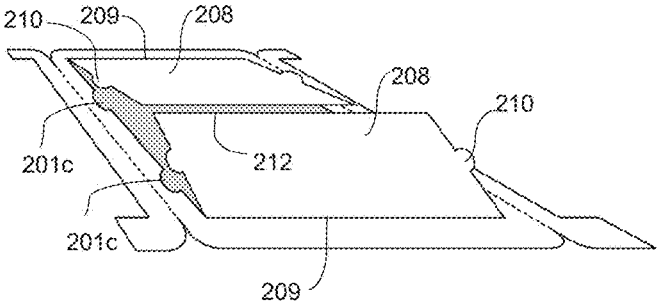
FIG. 118 shows an isometric view of the secondary reinforcement arrangement (300).

In an alternative embodiment of the invention, the lid (208) has a cut (212) in its middle part, which can be arranged diagonally or between any of its sides. Said cut (212) allows total or partial access to the interior of the contents of the container, providing for such purposes even the incorporation of a second lid fold (209) that allows the articulation of each lid (208), as shown in FIGS. 117 and 118.

In an alternative embodiment of the invention, the lid (208) is arranged partially meeting the lid fold (209) in a portion within the surface of the same lid (208), as shown in FIGS. 131-134.

Figure 119:
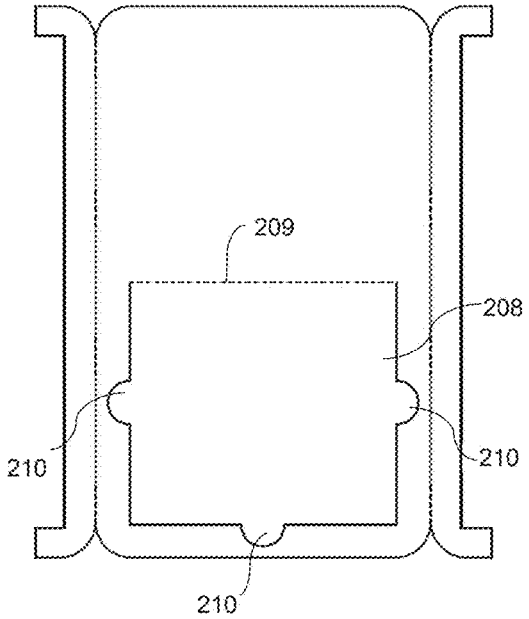
FIG. 119 shows a top view of the secondary reinforcement arrangement (300).
Figure 120:
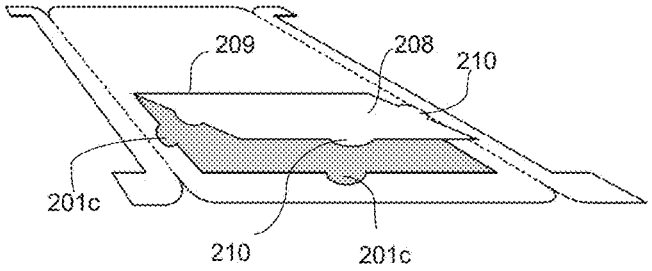
Figure 121:
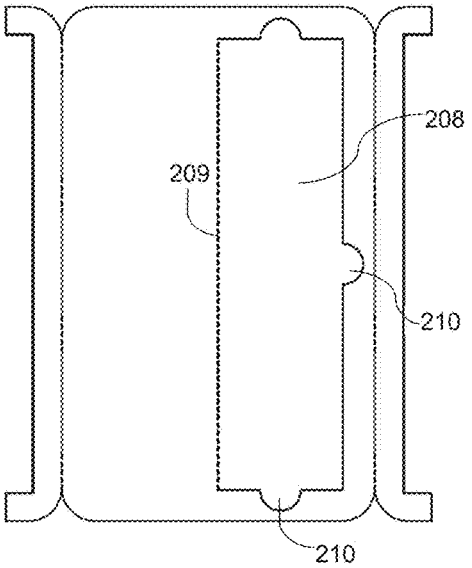
Figure 122:
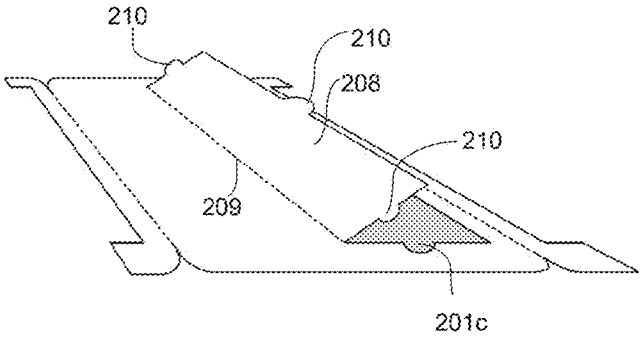

In an alternative embodiment of the invention, there is an embodiment of the lid (208) where it is placed completely between the folding section (203) with the intention of having a total blockage of access to the interior of the container, as shown in FIGS. 119 and 120.

Figure 125:
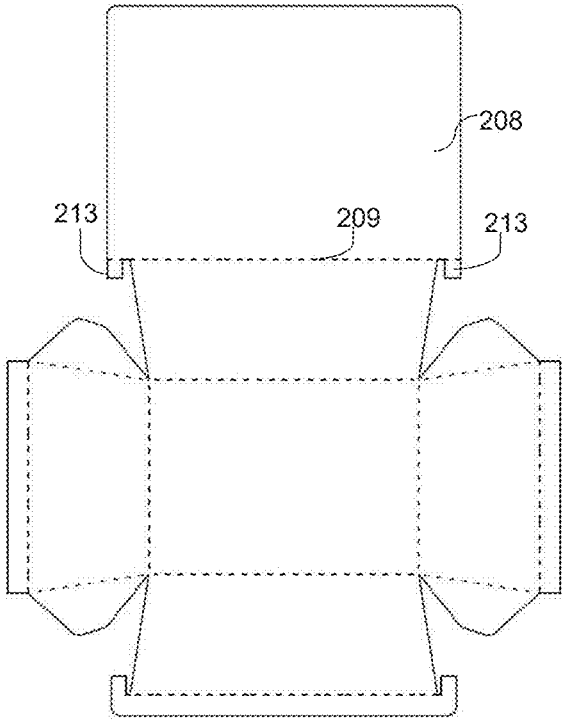
Figure 126:
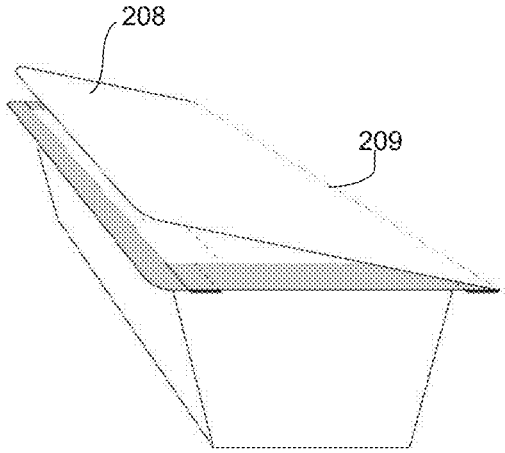

In yet another embodiment of the invention, the lid (208) is detached from the structure of the body of the container (100), finding that the lid (208) has a pair of extensions (213), which are arranged on each of the sides of the lid fold (209) that is in communication with the lid (208); therefore, the surface located on the lower periphery of the lid (208) can adhere to the upper surface of the frame of the container, as can be seen in FIGS. 125 and 126.

Figure 127:
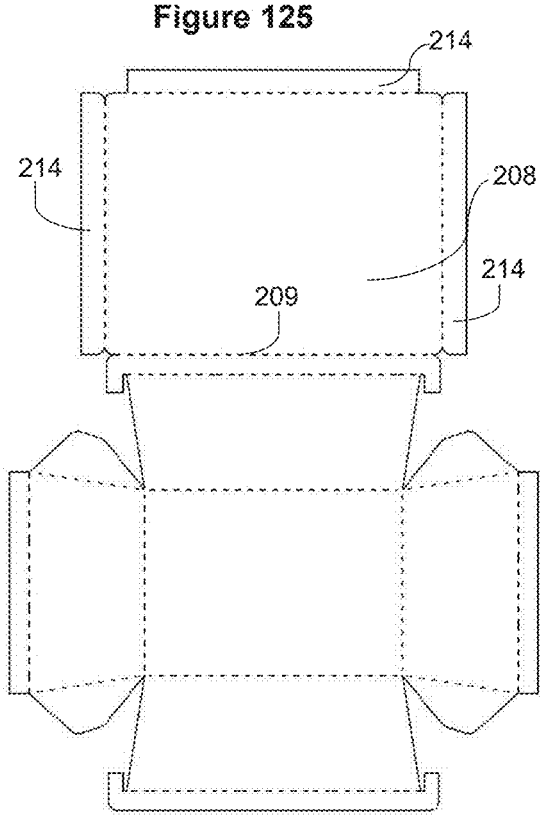
Figure 128:
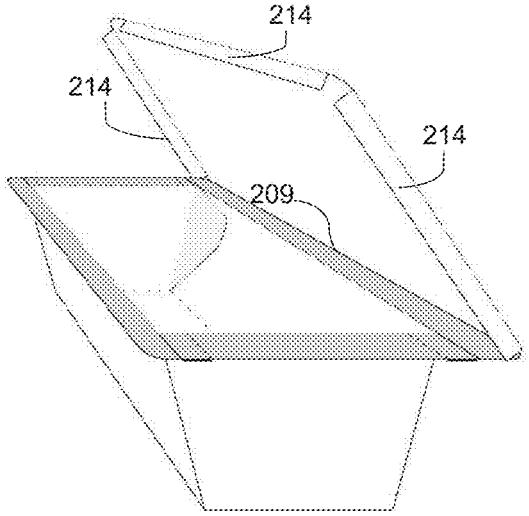

In yet another embodiment of the invention, the lid (208) is detached from the structure of the body of the container (100), finding that the lid (208) has folding tabs (214) distributed on each one of the sides that is not the lid fold (209) that is in communication with the lid (208), so that when folded with the container (100) assembled, these folding tabs can be folded to the bottom of the independent reinforcement frame and adhere to close the container, as shown in FIGS. 127 and 128.

It is important to point out that the advantages of incorporating a lid lie primarily in having a blocking element inside the container (100) and, consequently, in its contents. Additionally, the body of the lid (208) is made of a material that, if not used as a lid, would be wasted. Its permanence is particularly advantageous, as the acquisition cost of the material is not increased. In any case, the cost will have minimal variation depending on the manufacturing process required to carry out said cuts.

Furthermore, the incorporation or permanence of the material as a lid (208) does not imply variations in the independent reinforcement frame (200) in any of its embodiments. As will be seen in subsequent sections, the lid (208) can be arranged in many ways without interfering with the structure of the independent reinforcement frame (200).

The packaging of the containers with a lid does not present major issues either, since the lids are equipped with a sealing mechanism or arrangement that allows them to be moved into an open and stacked configuration. The lids (208) can remain sealed until the container has been filled with one or more objects.

The manner in which the container is sealed also contemplates procedures executed by computer-controlled machinery or manual adhesion methods carried out by a user.

The lid (208) can be labeled, printed, foliated, or treated with images using procedures known to a person skilled in the art, such as offset printing, flexography or digital printing on any of its surfaces.

It is still an additional object of the invention to incorporate a secondary reinforcement arrangement (300), which consists of a frame-like structure whose surface coincides with the surface of the central frame (201). This secondary reinforcement arrangement (300) is placed so as coincide with either the upper or lower surface of the central frame (201), or with both surfaces simultaneously. The secondary reinforcement (300) includes an upper secondary reinforcement (301), which joins with the upper part of the frame (201), and a lower secondary reinforcement (302), which joins with the lower part of the central frame (201). The incorporation of this secondary reinforcement increases the rigidity and resistance of the independent reinforcement frame (200). This incorporation or bonding can be achieved using adhesive elements such as wet glues, contact glues, one-component reactive adhesives, two-component reactive adhesives, hot-melt glues, self-adhesive materials, cyanoacrylate glues and others.

In an alternative embodiment of the secondary reinforcement, it includes a folding side (303) that joins the upper secondary reinforcement (301) and the lower secondary reinforcement (302) on one of the sides. This arrangement allows for a more comfortable, faster and more precise fit with the body of the central frame, making the installation process easier for the user or the equipment that places these components.

Furthermore, in another alternative embodiment of the secondary reinforcement (300), in addition to integrating a folding side (303), it also includes a cover (304) that coincides with the upper secondary reinforcement (301). In other words, the cover (304) is arranged in the gap created by the lower secondary reinforcement (302), resulting from its alignment with the central frame (201) This configuration allows for the integration of an element that covers the interior of the container.

The lateral extensions can be configured to form, when locked, a relief adapted to fit into an opening made on the lateral side of the bottom they cover. As such, a bottom with an opening on each side surface can be utilized.

In this way, the coercion of the locking means of a lid with the complementary locking means of the lid allow an easy closing of the container.

The foregoing description of preferred embodiments of the invention has been presented for purposes of illustration and description. Furthermore, the description is not intended to limit the invention to the form described herein. Accordingly, variations and modifications consistent with the above teachings within the skill or knowledge of the relevant art are within the scope of the present disclosure. The embodiments described hereinabove are further intended to explain the currently known best mode of practicing the disclosure and to enable others skilled in the art to use the invention in such or other embodiments and with various modifications required by the particular application or use of the invention. the invention. The appended claims are intended to be construed to include alternative embodiments to the extent permitted by the prior art.

The invention claimed is:

1. A container with an independent reinforcement frame comprising:

a container (100) made up of a bottom wall (101) of regular or irregular polygonal shape with a plurality of edges (102), from each of which a sidewall (103) extends upwardly, and a plurality of adjacent sidewalls (104) connected between the sidewalls (103);

each sidewall (103) has a top edge (105) which is foldable and adopts a horizontal configuration when the container (100) is assembled;

a closure flap (106) articulately connected to the top edge of each adjacent sidewall (104), wherein the closure flaps (106) are folded inwardly or outwardly relative to the container (100) to form a closing arrangement, each adjacent sidewall (104) having a secondary upper edge (107) that is foldable and fixed by an adhesive medium to the top edge (105), wherein the secondary upper edge (107) adopts a horizontal configuration once the container (100) is assembled; and an independent reinforcement frame (200) attached to the container (100) and comprising a central frame (201), wherein the central frame (201) is positioned above the top edge (105) and the secondary upper edge (107) of the container (100), wherein the configuration of an internal periphery (201*a*) of the central frame (201) coincides with an upper part of a periphery of a receiving cavity defined within the container (100);

a folding tab (202) attached to the central frame (201) by a folding section (203), wherein the connection between the folding tab (202) and the central frame (201) is located on an outer side of the central frame (201);

wherein at each the folding tabs (202) includes, at each of its ends, a reinforcement tab (204) arranged perpendicular to the folding section (203) and to the side of the central frame (201) that coincides with said folding section (203), the reinforcement tab (204) being arranged linearly with respect to a side of the central frame (201) that is perpendicular to the lateral folding tab (202); and wherein when the folding tab (202) is folded, the folding tab (202) adheres to a lower part of the top edge (105) of the container (100) while the reinforcement tab (204) adheres to a portion of a lower part of the secondary upper edge (107).

2. The container with the independent reinforcement frame according to claim 1, wherein the container (100) has an anti-spill arrangement in which an intermediate tab (108*a*) is arranged at an interface between the side walls (103) and the adjacent sidewalls (104) of the container (100), the intermediate tab (108*a*) having a configuration including folds on each of the sidewalls (104).

3. The container with the independent reinforcement frame according to claim 1, wherein a portion of the bottom wall (101) includes a groove (111), which optionally extends to an area near a middle part of each of the side walls (103); the groove (111) having spacer tabs (112) arranged on each side thereof and foldable toward an interior or exterior of the container (100), wherein the spacer tabs (112) are joined with a separating device (113) including a dividing body that includes a plurality of separating walls (114) having a bottom tab (115) that connects with the bottom wall (101) of the container (100), and an upper profile (116) corresponding to a highest portion of the separating device (113); the spacer tabs (112) are joined with the separating device (113) to form cavities within the container (100) and the separators have different shapes and structures, allowing the container (100) to have one or more separators.

4. The container with the independent reinforcement frame according to claim 1, wherein the reinforcement frame (200) comprises a central frame (201) supporting the other components of the reinforcement frame (200), wherein the configuration of an internal periphery (201*a*) of the central frame (201) coincides with an upper part of a periphery of a receiving cavity defined by the container (100), which comprises a regular or irregular polygonal shape and wherein a folding tab (202) is attached to the central frame (201) by a folding section (203) located on an outer side of the central frame (201), and wherein at each end of the folding tabs (202) includes a reinforcement tab (204) arranged perpendicular to the folding section (203) and to the side of the central frame (201) that coincides with said folding section (203), and wherein the reinforcement tab (204) is also arranged linearly with respect to a side of the central frame (201) that is perpendicular to the folding tab (202), wherein when the reinforcement tab (204) is folded, the reinforcement tab (204) adheres to the lower part of the top edge (105) of the container (100), when the container (100) includes an excess material section or folded edge on two sides, and when the container (100) lacks the excess section, the reinforcement tab (204) adheres to a lower part of the central frame (201) such that the folded position of the folding tab (202) coincides with the lower surface of an area where the top edge (105) is located.

5. The container with the independent reinforcement frame according to claim 1, wherein the independent reinforcement frame (200) integrates an external tab (205) arranged on an external side of the folding tab (202), where said external tab (205) is connected to the folding tab (202) by an external tab fold (205*a*), the external tabs (205) extends from a middle portion of the folding tab (202) to an area close to each of the reinforcement tabs (204), an additionally integrates an internal tab (206) located on an internal side of the central frame (201) parallel to the folding tab (202), wherein said internal tab (206) is joined to an internal wall of the side wall (103) of the container (100) by an internal fold (206*a*), the internal tabs (206) extends from the middle portion of the folding tab (202) to an area close to each of the reinforcement tabs (204).

6. The container with the independent reinforcement frame according to claim 1, wherein the independent reinforcement frame (200) includes a sectioning (201*b*) in an upper part and a lower part of the central frame (201) on portions that are free of the folding tab (202), wherein the sectioning (201*b*) has a straight or diagonal direction as well as regular or irregular shapes the sectioning (201*b*) being configured to reduce the material used in a linear area of the central frame (201) adjacent to the folding tab (204).

7. The container with the independent reinforcement frame according to claim 1, wherein the independent reinforcement frame (200) is free of folding tabs (202), and is formed solely by the central frame (201) which is placed on top of the container (100) and maintain adhesion with the reinforcement tabs (204) arranged on the container (100), wherein the union generates a complete structure of independent reinforcement frame (200).

8. The container with the independent reinforcement frame according to claim 1, wherein the container (100) includes reinforcement tabs (204) joined to a reinforcement frame (200) which is free of folding tabs (202), the union between the reinforcement tabs (204) and the reinforcement frame (200) forming the independent reinforcement frame structure, wherein a preform of the container (100) includes folding tab components (202).

9. The container with the independent reinforcement frame according to claim 1, wherein the container (100) includes reinforcement tabs (204) joined to a reinforcement frame (200) that is free of folding tabs (202), the union between the reinforcement tabs (204) and the reinforcement frame (200) forming the independent reinforcement frame (200), wherein a preform of the container (100) includes a folding tab components (202), and wherein the central frame (201) includes a sectioning (201*d*) on one sides of the frame configured to facilitate the incorporation of a two-part frame, the central frame (201) being positioned on top of the container (100) and maintaining adhesion with the reinforcement tabs (204).

10. The container with the independent reinforcement frame according to claim 1, wherein the central frame (201) whether in a continuous form or a divided into separate sections is joined or adhered to the folding tabs (202) and the reinforcement tabs (204) of the container (100), the adhesion being made either on an upper plane or a lower plane of the central frame (201), depending on whether the independent reinforcement frame (200) is free of reinforcement tabs (204).

11. The container with the independent reinforcement frame according to claim 1, wherein the reinforcement tabs (204) have a configuration symmetrical to a portion of an adjacent vertex of the central frame (201) at which the reinforcement tabs (204) are positioned.

12. The container with the independent reinforcement frame according to claim 1, wherein the reinforcement tab (204) has a reduced symmetry configuration relative to a shape of an adjacent vertex of the central frame (201) which the reinforcement tab (204) is positioned.

13. The container with the independent reinforcement frame according to claim 1, wherein the reinforcement tab (204) has an asymmetrical configuration relative to the shape of an adjacent vertex of the central frame (201) at which the reinforcement tab (204) is positioned while maintaining an extension or a dimension that does not exceed the limits defined by the shape of the adjacent vertex of the central frame (201) when folded.

14. The container with the independent reinforcement frame according to claim 1, further comprising separation elements (117) each separation element including one or more rows adapted to a portion of the wall or the sidewalls of the container (100) and arranged so as to define internal dividers, wherein the dividers are configured to form adjoining compartments within the container (100).

15. The container with the independent reinforcement frame according to claim 1, further comprising a thermoformed cover configured to be mounted on the container (100) or on the independent reinforcement frame (200).

16. The container with the independent reinforcement frame according to claim 1, further comprising a modified atmosphere packaging including a coating film (400) applied to a body of the container (100) with the independent reinforcement frame (200).

17. The container with the independent reinforcement frame according to claim 1, wherein the container (100) is made of manila paper, cardboard, Kraft cardboard, caple cardboard, SBS cardboard, multilayer cardboard, another cellulose-based substrate, or thin plastic.

18. The container with the independent reinforcement frame according to claim 1, wherein a material used to form the container (100) and the independent reinforcement-frame (200) is laminated with a film made of a polymeric material such as PE, PET, PVC, PEEK or metallic material.

19. The container with the independent reinforcement frame (1) according to claim 1, wherein the container (100) and the independent reinforcement frame (200) are joined together by an adhesive or adhesion promoters, including wet glues, contact adhesives, reactive adhesives, single component reactive adhesives, two components of multi-components reactive adhesives, hot melt adhesives, or self-adhesives.

20. The container with the independent reinforcement frame according to claim 1, wherein the independent reinforcement frame (200) includes a lid (208), made from the same material as a material of the independent reinforcement frame (200), wherein the lid (208) is supported on one sides of an internal periphery (201*a*) of the independent reinforcement frame (200) by a lid fold (209), and further includes a plurality of joining devices (210) protruding from a body of the lid (208) and inserted into reception cavities (201*c*) formed in the central frame (201), wherein the arrangement provides initial blocking restricts access to an interior of the container (100), and wherein the set of reception cavities (201*c*) and the joining device (210) are joined by adhesive devices; adhesive elements; adhesive materials; breakable devices; adhesive seals; mechanical locks including staples or clasps, hook and loop closures; magnetic devices; or self-adhesive devices.

21. The container with the independent reinforcement frame according to claim 1, wherein the independent reinforcement frame (200) includes a lid (208) attached to the independent reinforcement frame (200) by a series of joining devices (210).

22. The container with the independent reinforcement frame according to claim 1, wherein the independent reinforcement frame (200) includes a lid (208) having a lid fold (209) aligned with the folding section (203) of the central frame (201).

23. The container with the independent reinforcement frame according to claim 1, wherein the independent reinforcement frame (200) includes a lid (208) having a lid fold (209) aligned with a central portion of an external periphery of on sides of the central frame (201), the lid (209) defining an extension (209*a*) that projects from an internal periphery (201*a*) of the central frame (201) toward an area near the folding section (203).

24. The container with the independent reinforcement frame according to claim 1, wherein the independent reinforcement frame (200) includes a lid (208) having a pair of fastening tabs (211) positioned on respective sides perpendicular to the folding tabs (202).

25. The container with the independent reinforcement frame according to claim 1, wherein the independent reinforcement frame (200) includes a lid (208) having a lid fold (209) incorporated on any of the sides perpendicular to the folding tabs (202).

26. The container with the independent reinforcement frame according to claim 1, wherein the independent reinforcement frame (200) includes a lid (208) having a cut (212) at a middle portion of the lid (208), the cut (212) being configured to extend diagonally or along-any of the of its-sides of the lid (208).

27. The container with the independent reinforcement frame according to claim 1, wherein the independent reinforcement frame (200) includes a lid (208) having a lid fold (209) formed on a portion of a surface of the lid (208).

28. The container with the independent reinforcement frame according to claim 1, wherein the independent reinforcement frame (200) includes a lid (208) that is completely positioned between the folding section (203).

29. The container with the independent reinforcement frame according to claim 1, wherein the independent reinforcement frame (200) includes a lid (208) detached from a structure of the container (100), the lid (208) having a pair of extensions (213), positioned on respective sides of the lid fold (209) and in communication with the lid (208); wherein a surface located along a lower periphery of the lid (208) is configured to adhere to an upper surface of the reinforcement frame (200).

30. The container with the independent reinforcement frame according to claim 1, wherein the independent reinforcement frame (200) includes a lid (208) detached from the container (100), the lid (208) having a plurality of folding tabs (214) distributed along sides other than the side including the lid fold (209) and in communication with the lid (208).

31. The container with the independent reinforcement frame according to claim 1, further comprising a secondary reinforcement (300), wherein the secondary reinforcement (300) comprises a frame-like structure having a surface that coincides with a surface of the central frame (201) and is positioned on with either an upper surface or a lower surface or both surfaces of the central frame (201), wherein the secondary reinforcement (300) includes an upper secondary reinforcement (301) joined to an upper part of the central frame (201) and a lower secondary reinforcement (302) joined to a lower part of the central frame (201), the incorporation of the secondary reinforcement (300) increasing rigidity and strength of the independent reinforcement frame (200), and wherein bonding is achieved by adhesive elements including wet glues, contact glues, one-component reactive adhesive, two-component reactive, adhesives hot melt adhesives, self-adhesive materials, or cyanoacrylate glues.

32. The container with the independent reinforcement frame according to claim 1, further comprising a secondary reinforcement arrangement (300); having which has a folding side (303) joining the upper secondary reinforcement (301) and the lower secondary reinforcement (302) along one of their sides.

33. The container with the independent reinforcement frame according to claim 1, further comprising a secondary reinforcement (300) having a cover (304) coinciding with the upper secondary reinforcement (301).

34. The container with the independent reinforcement frame according to claim 1, further comprising a lid (208) configured to be labeled, printed, foliated, marked, or signaled.

* * * * *